US005910598A

United States Patent [19]

Shofner et al.

[11] Patent Number: 5,910,598

[45] Date of Patent: Jun. 8, 1999

[54] MODULAR PROCESS ZONE AND PERSONNEL ZONE ENVIRONMENTAL CONTROL WITH DEDICATED AIR JET CLEANING

[75] Inventors: Frederick M. Shofner, Knoxville; Dennis J. Roeder, Powell, both of Tenn.

[73] Assignee: Shofner Engineering Associates, Inc., Knoxville, Tenn.

[21] Appl. No.: 08/550,710

[22] Filed: Oct. 31, 1995

Related U.S. Application Data

[63] Continuation-in-part of application No. 08/333,364, Nov. 2, 1994, abandoned.

[51] Int. Cl.[6] ..... B65H 54/70; D03J 1/00

[52] U.S. Cl. ..... 55/385.2; 55/467; 139/1 C

[58] Field of Search ..... 55/385.1, 385.2, 55/385.7, 283, 422, 467, DIG. 18; 139/1 C

[56] References Cited

U.S. PATENT DOCUMENTS

| | | | |
|---|---|---|---|
| D. 282,767 | 2/1986 | Shofner . | |
| 1,676,969 | 7/1928 | Sutton et al. . | |
| 2,924,062 | 2/1960 | Sutcliffe . | |
| 3,373,552 | 3/1968 | Scherr | 139/1 C |
| 3,923,482 | 12/1975 | Knab et al. . | |
| 3,926,104 | 12/1975 | El Dorado . | |
| 3,999,911 | 12/1976 | Matsubara . | |
| 4,050,368 | 9/1977 | Eakes . | |
| 4,109,144 | 8/1978 | Vidmar . | |
| 4,222,754 | 9/1980 | Horvat | 55/283 |
| 4,227,552 | 10/1980 | Baumann . | |
| 4,255,169 | 3/1981 | Leliaert et al. . | |
| 4,512,060 | 4/1985 | Shofner . | |
| 4,631,781 | 12/1986 | Shofner . | |
| 4,686,744 | 8/1987 | Shofner . | |
| 4,753,663 | 6/1988 | Neefus et al. . | |
| 4,881,957 | 11/1989 | Shofner . | |
| 5,121,522 | 6/1992 | Leifeld et al. . | |
| 5,305,498 | 4/1994 | Lang . | |
| 5,361,450 | 11/1994 | Shofner et al. . | |
| 5,472,018 | 12/1995 | Verner et al. . | |
| 5,487,766 | 1/1996 | Vannier . | |

FOREIGN PATENT DOCUMENTS

| | | |
|---|---|---|
| 461 411 | 12/1991 | European Pat. Off. . |
| 0 604 874 | 7/1994 | European Pat. Off. . |
| 0 604 876 | 7/1994 | European Pat. Off. . |
| 2 409 335 | 6/1979 | France . |
| 690 287 | 3/1940 | Germany . |
| 40 37 006 | 5/1992 | Germany . |
| 56-54721 | 4/1981 | Japan . |
| 62-261840 | 11/1987 | Japan . |
| 1-102232 | 4/1989 | Japan . |
| 1-238022 | 9/1989 | Japan . |
| 584 302 | 1/1977 | Switzerland . |
| WO 96/14262 | 5/1996 | WIPO . |

OTHER PUBLICATIONS

International search report dated Apr. 15, 1996 in PCT/US 95/13796.

*Primary Examiner*—C. Scott Bushey
*Attorney, Agent, or Firm*—Carter & Schnedler, P.A.

[57] ABSTRACT

Gas flows, whose plurality of conditions are controlled by modular environmental control apparatus, are sourced to or captured from various critical zones in materials processing machines, or in related personnel zones. A plurality of processing performance parameters, part of which may respond differently to environmental conditions in one or more process zones, and thus may be in conflict with each other, are jointly optimized to yield maximum gross profit, to produce highest quality, to operate at highest throughput, etc, (but not necessarily simultaneously). The principal embodiments herein disclosed are directed toward modular process zone and personnel zone environmental control in textile processing machines, in fiber, yarn or fabric manufacturing processes, but the method is very basic and powerful, and those skilled in the art will recognize the applicability to materials processing in general.

6 Claims, 34 Drawing Sheets

MODULAR PROCESS ZONE AND PERSONNEL ZONE ENVIRONMENTAL CONTROL WITH DEDICATED AIR JET CLEANING

CROSS-REFERENCE TO RELATED APPLICATION

This is a continuation-in-part of application Ser. No. 08/333,364 filed Nov. 2, 1994 now abandoned.

FIELD OF THE INVENTION

This invention relates generally to control of environmental parameters for manufacturing processes and, more particularly, to the control of gas flow parameters within process zones of materials processing machines and within personnel work zones associated therewith.

BACKGROUND

Relevant prior art includes central air conditioning systems which can control to or "hold" reasonably uniform (spatially) and stable (temporally) desired humidity and temperature conditions, as monitored by one or more chart recorder/controllers in the process room. They generally, cannot, however, "hold" such air conditions in each and every process zone and cannot always provide satisfactory environmental conditions for personnel zones. Furthermore, invariant conditions may not yield maximum profit. Relevant prior art also includes traveling cleaners. Both are described hereinbelow in detail.

Relevant patent prior art includes Shofner U.S. Pat. Nos. 4,512,060, 4,631,781 and 4,686,744; Shofner U.S. Pat. No. 4,881,957; and Leifeld et al U.S. Pat. No. 5,121,522.

SUMMARY OF THE INVENTION

Briefly, the invention provides an environmental control apparatus unit including a gas flow source element and a gas flow capture element positionable in close proximity to a process zone of a materials processing machine, such as a textile weaving machine. Close proximity results in a high volumetric exchange rate and more effective isolation of process zones and personnel zones. Source gas flows of differing parameters may be delivered to different process zones and personnel zones. Gas flow capture elements of different characteristics influencing various zones are also provided. The environmental control apparatus unit of the invention also has elements for conditioning gas flows delivered by the gas flow element.

Advantageously, the environmental control apparatus unit of the invention is mechanically arranged for selective clearance from the process zone for maintenance purposes.

The invention also provides an environmental control system for a plurality of textile processing machines. The system includes an environmental control apparatus unit for each of the machines, and each environmental control apparatus unit includes a gas flow source element and a gas flow capture element positionable in close proximity to the process zone of the corresponding machine.

The invention further provides a method for processing materials in a machine, including the steps of measuring at least one processing performance parameter; and at least partially controlling the at least one processing performance parameter in accordance with a predetermined optimal control strategy by deliberately applying a gas flow conditioned by at least one controlling parameter, said gas flow being applied to the machine by at least one modular control unit.

The invention, in ultimately condensed summary, has two major objectives for materials processing machines:

I. Provision of individually controlled or conditioned gas flows to and from process zones and personnel zones associated with said machines; and II. Improved optimal process control for said machines.

BRIEF DESCRIPTION OF THE DRAWINGS

While the novel features are set forth with particularity in the appended claims, the invention, both as to organization and content, will be better understood and appreciated, from the following detailed description taken in conjunction with the drawings, in which:

FIGS. 6H, 6I, and 6J are frontal views showing projectile filling insertion with synchronously pulsed air jet cleaners;

DETAILED DESCRIPTION

A. Weaving Essentials: Air Jet Looms

Presented initially in this Section is an overview of the essential elements and operations of the weaving process, and particularly of an "air jet" weaving process zone 60 to be environmentally conditioned and optimally controlled in accordance with our invention. Modern weaving is a good example of materials processing to which our invention generally applies. This overview is particularly useful because the apparatus and methods of the invention are much more highly integrated with the weaving process than is possible with prior art environmental controls. It will be appreciated that modern weaving is a highly complex process involving a wide range of supporting equipment and skilled personnel. This initial overview enables simpler and clearer disclosures later and it will provide a sense of technological evolution now.

Figure 1:
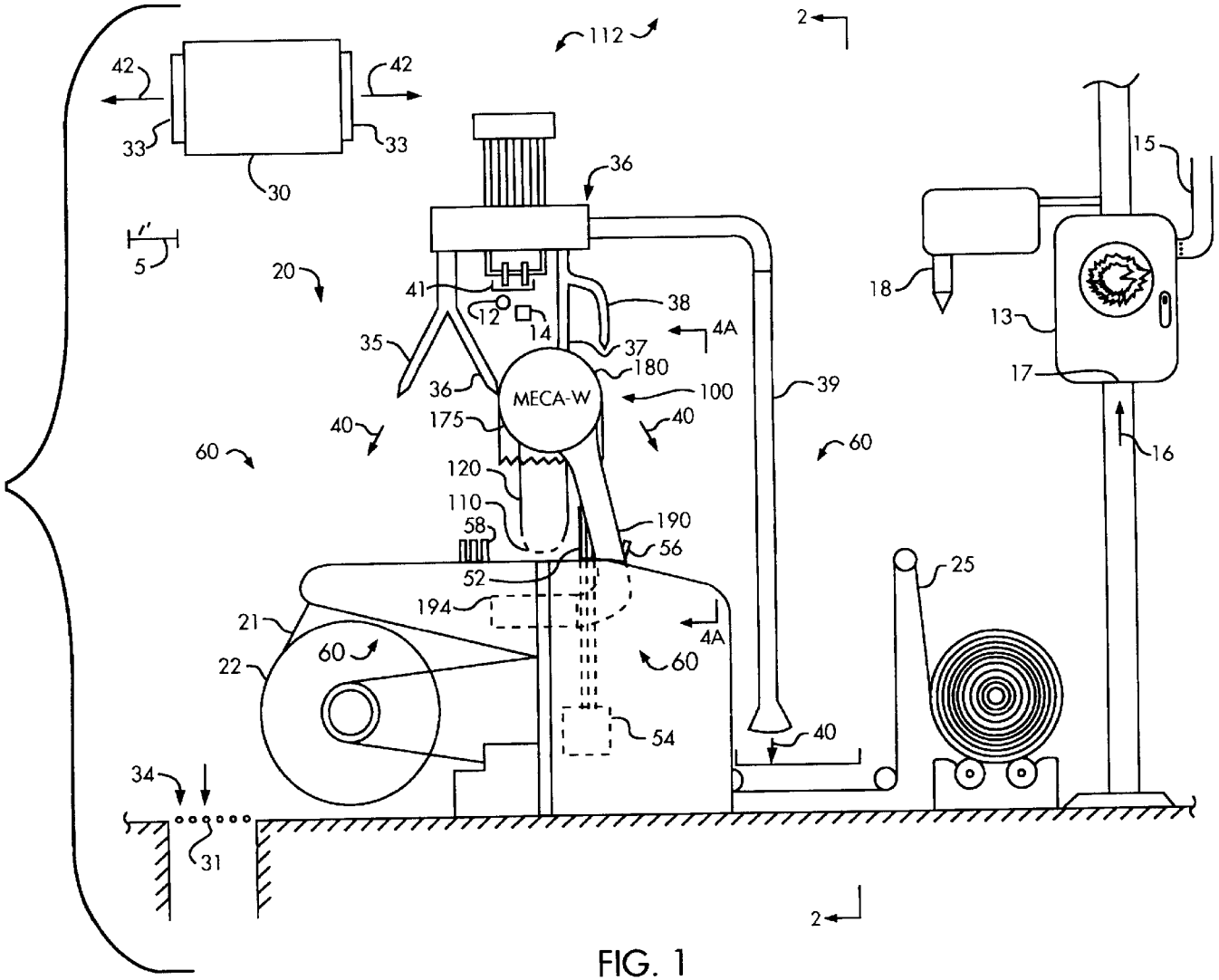
FIG. 1 is a left end view of a modular environmental control apparatus (MECA) unit of the invention applied to a weaving machine shown in side view, the view of FIG. 1 being taken on line 1—1 of FIG. 2.
Figure 2:
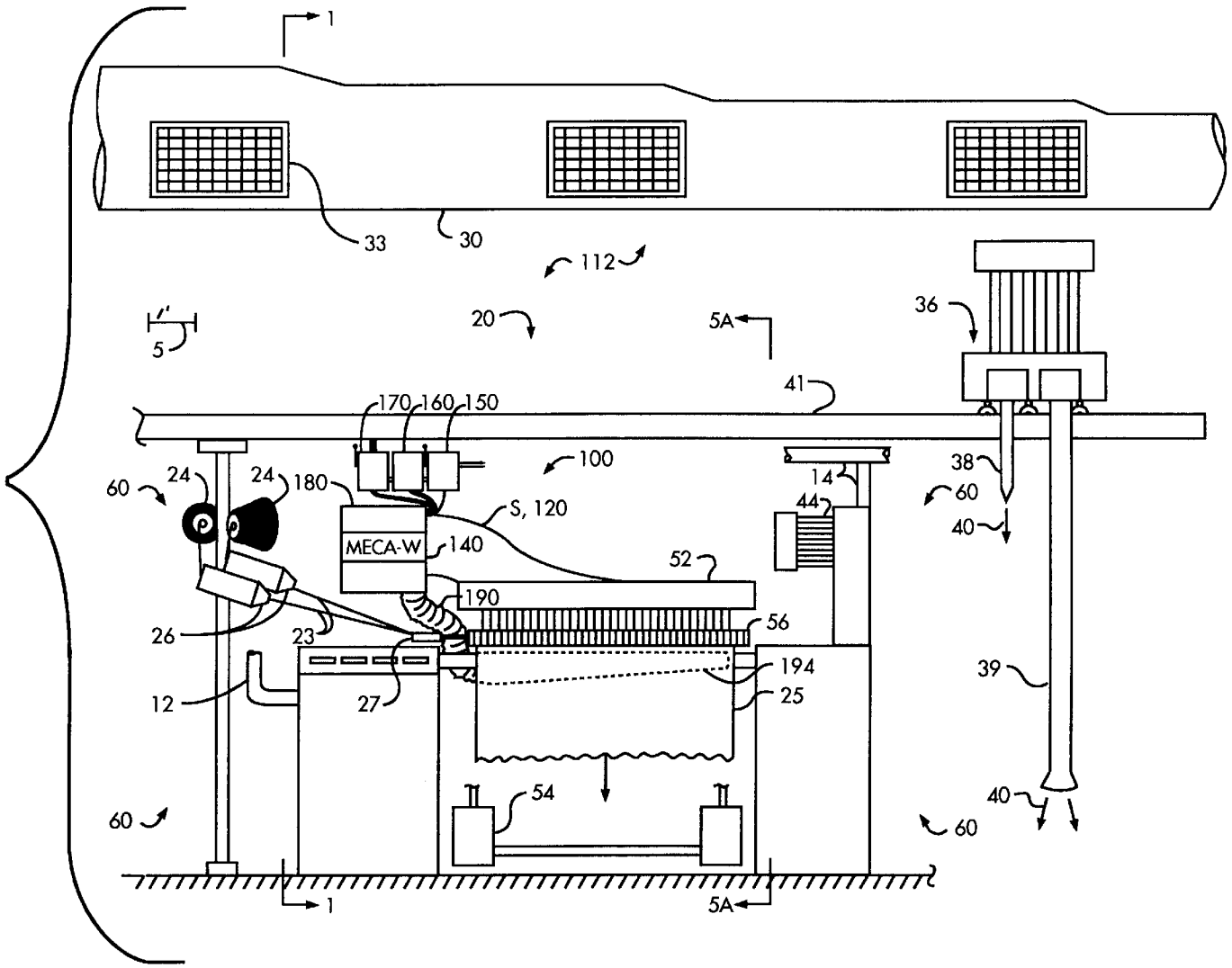
FIG. 2 is a front view of the MECA unit of the invention and a front view of the weaving machine, taken on line 2—2 of FIG. 1.
Figure 3A:
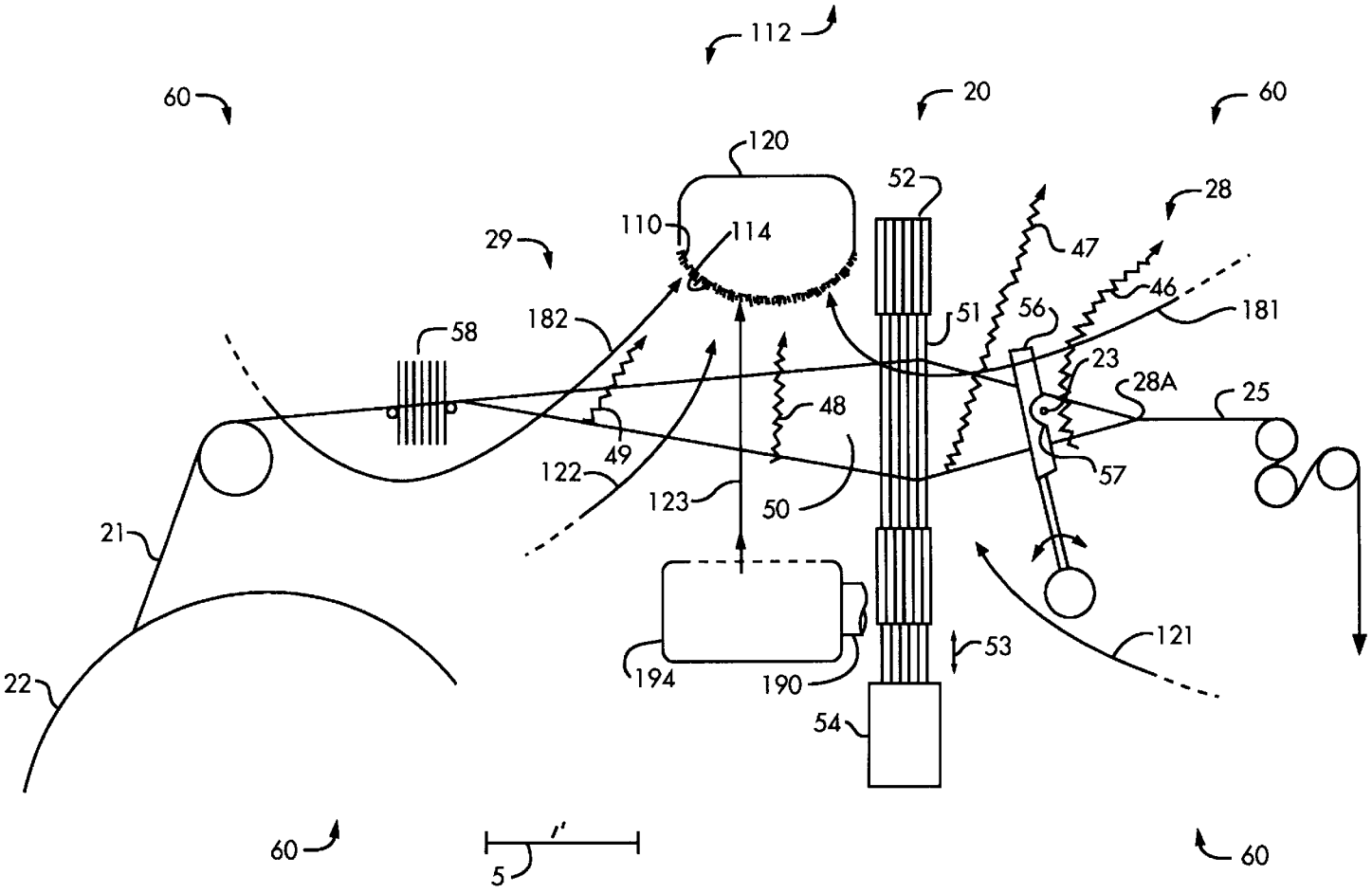
FIGS. 3A and 3B are enlarged views of the weaving process zone.
Figure 3B:
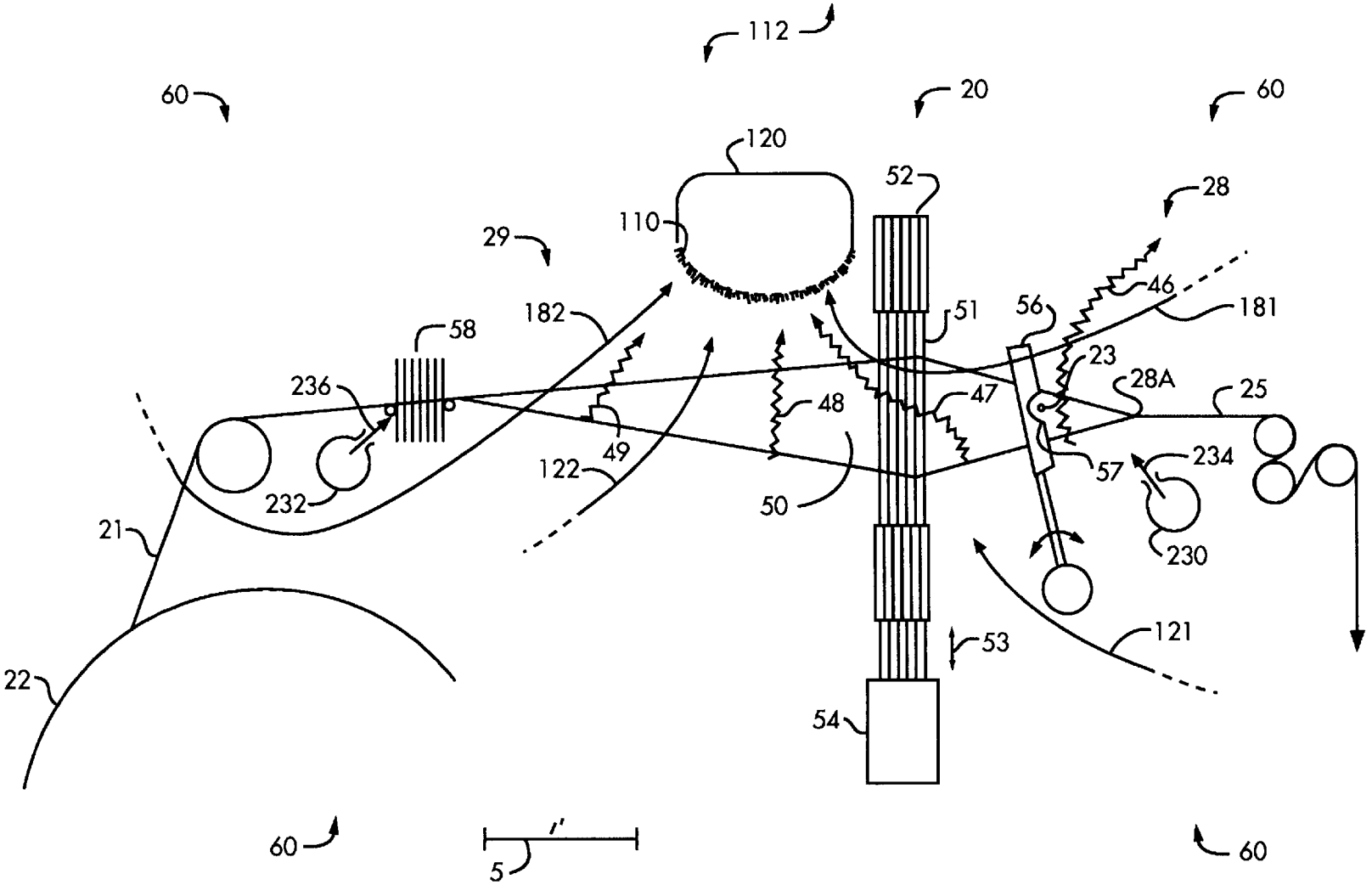

Thus, referring first to FIGS. 1 and 2, a representative environment for the invention is a weaving machine 20 or loom 20 within a weave room environment 112. The weaving machine 20 converts warp yarn 21, supplied from the warp beam 22, plus filling yarn 23 (called weft-yarn in British English), supplied from filling packages 24, into cloth 25. FIGS. 3A and 3B are enlarged views of the Weaving Process Zone, generally designated 60. Also shown in FIGS. 1, 2, 3A and 3B are a number of elements comprising the invention and described hereinbelow, such as a Modular Environmental Control Apparatus (MECA) unit 100, a collector 120, a directed source air diffuser 194, and a conduit 190 supplying it.

The weaving process zone more particularly includes the filling packages 24, accumulators 26, filling yarn 23, and primary air jet nozzles 27 (FIG. 2). Accumulators 26 facilitate feeding the filling yarn 23 into the primary air jet nozzles 27 and then into a front shed 28 (FIG. 3A). Compressed air and electrical power are supplied by pipe 12 and wire conduit 14.

Filling insertion by means of air jet nozzles 27 leads to the designation "Air Jet Loom." Air Jet Looms are manufactured, for example, by Nissan Motor Company, Textile Division, Tokyo, Japan and Toyota Motor Company, Textile Division, Tokyo, Japan. Toyota manufactures air jet looms under a license from Sulzer-Rüti Company, Rüti, Switzerland. Sulzer-Rüti also makes projectile looms, as discussed hereinbelow.

Air jet looms 20 have the major advantage of very high filling insertion or "pick" rates, about 600 per minute, currently. These high production rates lower production costs but place heavy demands on yarn strength and elongation, both of which are influenced strongly by environmental conditions in process zone 60, and which high production rates lead to severe environmental problems including but not limited to those associated with high energy dissipation, high release of dust and fibers, high generation of static electricity, and high noise emissions and turbulent air flows from the weaving process zone 60. Filling insertion rates have risen from about 80/MIN in 1950 (shuttle looms) to about 250/MIN in 1970 (projectile, rapier), to about 600/MIN beginning in the 1980s and operating currently. Next-generation air jet looms having filling insertion rates of 1800/MIN and even higher are already under field trials. Projectile and rapier weaving machines have also increasing filling insertion rates to 400 per minute, in some cases.

The revolution in weaving and its associated heavy demands on environmental conditioning will thus be appreciated. Similar considerations apply to all materials processing in general.

Referring again to FIG. 3A, there is a back shed 29 which corresponds to the front shed 28, being respectively in back of or in front of the harness 52. A shed opening 50 is produced by alternating vertical movements of heddle wires 51, through which each of the several hundred to several thousand warp yarn ends 21 pass. The heddle wires 51 are carried by harnesses 52, which harnesses 52 are driven up and down 53 by the harness drive machinery 54 of the loom. Typically, the maximum shed opening is four inches at heddle wires 51 for weaving denim openings of two to six inches are found for other fabric constructions.

During operation, when the reed or beater 56 is in its back position, as shown in FIG. 3A, the filling yarn 23 is rapidly inserted by one of the primary air jet nozzles 27 (FIG. 2) and carried across the front shed 28 by secondary air jet nozzles (not shown) in the reed tunnel 57. Reed 56 next moves forward to pack or beat the filling yarn 23 into cloth 25. Upon the reed 56 moving backward, the filling yarn 23 remains at the apex 28A of the front shed 28 and moves out of tunnel 57, while heddles 51 (carried by harness 52) shift to cause the warp yarns 21 to envelope the filling yarn 23 and form cloth 25.

Also shown in FIG. 3A is a drop wire stop motion assembly 58 the function of which is to stop the loom 20 in the event of a warp yarn break. This stop motion is achieved when any one of the hundreds to thousands of drop wires fall onto an electrical shorting bar within assembly 58 due to loss of tension in the warp yarn end 21 supporting it. There are also stop motion sensors associated with correct filling yarn insertion, correct selvage formation, or numerous other actions. Described hereinbelow is the manner in which the apparatus of the invention responds to certain such stop motions to enable the weaver to access all parts of the weaving machine 20 when repairing the problem that caused the stop; safety and non-interference are critical practical design parameters. Also described hereinbelow is the manner in which several environmental sub-zones within various parts of process zone 60 are individually controlled, sometimes to different conditions.

It will be appreciated that the rapid and intense actions imparted upon the warp yarn 21 and filling yarn 23 yield copious release of dust and fibers, heat, ions, noise, turbulence, etc. in the weaving of spun yarns, especially with cotton, and most especially with denim fabrics. The power consumed by the loom is typically 4 KW; more than half is consumed by loom motor 44 which drives the major actions of opening the shed 28, 29 and moving the reed 56. Interestingly, more power, sometimes as high as 6 KW, is consumed by compressors which provide the compressed air for air jets 27. Said compressors are located outside production environment 112.

Most of the loom power dissipation occurs within or under the front and back sheds 28 and 29. Consequently, heated, dried, electrically charged, dust-laden and fiber-laden air rises above the back shed 29 as represented by wavy arrows 48, 49 or is fanned away by the reed 56 in the front shed 28 of weaving zone 60 as represented by wavy arrows 46, 47. Noise emissions and turbulence are high as a result of the high production rates and mixing or fanning action of beater 56. MECA capture 120 and source 194 elements in FIG. 3A are considered not present for the above overview and for the overview Section B immediately following.

B. Prior Art Environmental Control for the Weaving Process

FIGS. 1 and 2 illustrate a central air conditioning supply duct 30, having discharge grills or louvers 33, underfloor air return ducts or tunnels 34, and a traveling cleaner 36 having blow-nozzles 35–39, all previously known. The underfloor return duct 34, with floor grate 31, is found in about half of the weaving processes; wall return is found in the rest, except for a few ceiling returns. The subject invention may be employed in new equipment and in some retrofit installations in conjunction with such prior art apparatus and methods, and they are accordingly described herein in some detail. That is, not only must the subject invention be integrated into the weaving process, it must also be compatible with and integrated into prior art environment control apparatus. It will be appreciated that our invention 100 can, in most cases, so effectively clean the process zone that traveling cleaners 36 can be eliminated. Further, in some embodiments, demands on—and costs of—central air conditioning can be reduced to providing comfortable working environment for personnel. The subject invention may also be employed alone, thus handling all aspects of weaving or materials processing zone environmental control and personnel zone environmental control.

Central Air Conditioning

More particularly, the air supply ducts 30 and grills 33 in FIGS. 1 and 2 deliver conditioned air 42 from central filtration, refrigeration, ion control, and humidification systems well known in the art. A typical central air conditioning system, designed and constructed according to prior art, delivers about 800,000 cubic feet per minute (CFM) to the typical large weave room processing cotton and attempts to maintain conditions of about 76° F. dry bulb temperature, 70% relative humidity, neutral charge concentrations, and respirable dust concentrations below 750 $\mu g/m^3$ (8 hour shifts) or 500 $\mu g/m^3$ (12 hour shifts). Said conditions are sensed by a single controller situated roughly centrally in a processing area containing about 50 looms. Because of increased production rate, and therefore power consumption per unit area or volume of manufacturing space, it has become increasingly difficult or prohibitively costly to achieve desirable environmental conditions in either the materials processing zone or in the associated zones which must be inhabited by operating personnel. In an increasingly large fraction of installations, the attempts are unsuccessful and conditions in the weaving process zone and/or in the personnel zone are not satisfactory. Failures to achieve desirable process zone environmental control or personnel zone environmental control are in major part attributable to increased production rates associated with modern looms. Further, little or no attention is given to noise control (pressure fluctuations) or to turbulence parameters (velocity fluctuations) in conditioned air 42 supplied to or returned from 34 weave rooms because the weaving machines are very noisy (approximately 95 dBA) and because the vigorous fanning actions of the beater or reed 56 enforce mixing.

It is useful to note that typical prior art central air conditioning systems for cotton fabric weaving have volumetric air exchange rates of about 25/hour or supply and return air flow rates of approximately 2000 CFM/loom. In sharp contrast, one of the important aspects of the invention described hereinbelow is high localized air exchange rate, typically more than one hundred exchanges per hour to several thousands per hour, in special, "tightly-coupled," cases.

It should be appreciated that conditioned air 42 is supplied from grills 33 that are typically between eight and thirty feet removed from the process zone 60. Conditioned air 42 provided at such large distances fails to achieve good environmental control within process zone 60 or control of dust and fiber and other emissions from process zone 60; exemplary data are provided at the end (this Section and further hereinbelow.)

It will also be appreciated that floor grate inlets 31 into underfloor return air tunnels 34 cause the "sink" for return air to be no closer than about 2.5 feet when the floor grate inlets 31 are located precisely under each shed 28, 29. However, the typical weaving plant must accommodate five to ten weaving machinery changes during its service lifetime of twenty-five to fifty years. Different looms will have different "foot-prints." Accordingly, since it is prohibitively expensive to relocate the underfloor tunnels 34 which are usually formed in a massive concrete floor, distances between the weaving process zone 60 and return air inlets 31 can also be as large as 30 feet. If wall or ceiling returns are used, these distances can be as large as 200 feet.

A new but still essentially "central" air conditioning system, modified to deliver different environmental conditions, on a machine-by-machine basis, to the process zones of the textile fiber process known as carding, is disclosed in Shofner et al U.S. Pat. No. 5,361,450, incorporated herein by reference, titled "Direct Control of Fiber Testing or Processing Performance Parameters by Application of Conditioned Gas Flows." It is not practical to apply the disclosed techniques of Shofner U.S. Pat. No. 5,361,450 to weaving. The disclosure of U.S. Pat. No. 4,361,450 relates to carding.

It may be noted that over shed air supplies from central air conditioning systems (even if the supply ducts therefor are compatible with traveling cleaners) cannot be closer to the shed 28, 29 than about 30 inches. Similarly, underfloor returns 34, provided they are directly under the shed 28, 29 cannot be closer than about 30 inches.

By contrast, in accordance with the present invention, it is recognized that one of the fundamental, generally-encountered limitations of prior art environmental controls especially for weaving is large and varying distances from the materials process zone 60. Our invention provides for closely proximate gas conditioning elements, typically closer than 30 inches and including a limiting case wherein the process zone is totally enclosed. Close proximity offers numerous and substantial benefits but creates problems which are easily solved, such as restricting operating personnel access, blockage of light, and extra heat load. Attempts, however, to apply prior art air conditioning concepts utterly fail to achieve the benefits of our invention.

Further realizations of limitations in prior art devices are also significant. Whereas central air conditioner recorder/controller 13 charts may indicate desired 76° F./70% conditions and respirable dust samplers 18 (such as Portable Continuous Aerosol Monitor (PCAM), manufactured by ppm, Inc., Knoxville, Tenn.) may indicate readings below 750 or 500 $\mu g/m^3$, which readings are fairly representative of the personnel zone, the reality of denim weaving process zone environmental conditions, for typical example, are 80° F./60% and 3,000 $\mu g/m^3$ respirable dust. Total dust mass concentration is much higher. Extreme readings of 83° F./55% and 20,000 $\mu g/m^3$ have been observed in the process zone while personnel zone readings indicated 76° F./70%, 1500 $\mu g/m^3$.

Traveling Cleaners

Traveling cleaner 36 (FIGS. 1 and 2), a purpose of which is to blow dust and fibers (sometimes called "fly") from top surfaces onto the floor, moves on electrified track 41 and passes over each loom 20 approximately every eight minutes for a duration of approximately thirteen seconds. In some processes (but typically not in weaving), traveling cleaners 36 also have capture or suction flows. Traveling cleaner 36 thus serves any one loom, in average, less than 3% of the time. Such traveling cleaners 36 are well known in the art and are manufactured, for example, by Luwa Parks-Cramer, Winston-Salem, N.C.

The traveling cleaner 36 does serve to blow dust and fibers ("fly") from top surfaces onto the floor and sometimes towards floor returns 34. Unfortunately, traveling cleaner 36 also blows, with high velocity, hot air jets 40, and can drive dust and fiber accumulations into sensitive parts of the weaving machine, causing stoppages and, sometimes, damage to the machine. Traveling cleaners can also blow dust and fibers onto the finished cloth, creating "slubs" or imperfections and, thereby, second quality fabric. Further, the "blowing around or stirring up" of dust or fibers is often a aggravation to personnel. Finally, traveling cleaners are completely unable to control air conditions, most especially in the weaving process zone 60. Indeed, except for short-duration removal of dust and fly from top surfaces, the impact of traveling cleaners on weave zone environmental conditions, on weaving performance, or on personnel are all negative. Thus, another purpose of the subject invention is to supplement or replace such infrequent, ineffective, and troublesome "cleaning" actions with dedicated cleaning actions.

From the above discussions, it can be appreciated that two purposes of the subject invention are to supplement central air conditioning and to eliminate traveling cleaners. However, these purposes are not the highest objective, which objective is to improve materials processing performance and enhance gross profit by optimally controlling environmental parameters in the process zone and, separately, in the personnel zone. Optimal control of process zone environmental parameters by our invention is recognized to enable a subset of optimal process control as described in Shofner et al published European Patent Application No. 0,604,876, which disclosure is incorporated herein by reference and which is discussed in Section E.

A final historical observation further clarifies our broad inventive objectives. For more than 100 years, materials processing machines and the personnel who operate them have coexisted in substantially the same environment. The observation is especially significant in textile manufacturing. This cohabitation has become increasingly incompatible, as machinery production rates have risen and as personnel tolerances for uncomfortable work zones has fallen. But why, we asked, must the machines and personnel "breathe" the same air? And does supposed equality of personnel zone and process zone conditions yield maximum gross profit?

Our invention answers these and other questions and, where economic justifications exist, materials processing can be performed in a substantially sealed envelope in a noble gas while operating personnel work in a comfortable, clean and quieter environment. Alternatively stated, our invention, for which we next disclose various preferred embodiments, enables separation or isolation of the process zones and personnel zones and individual control for each such zone.

C. Detailed Description of Preferred Embodiments

Modular Process Zone Environmental Control

The subject invention to which apparatus we shall refer as MECA (Modular Environmental Control Apparatus) enables process zone environmental control results heretofore impossible with central air conditioning supplies 30 and returns 34 and traveling cleaners 36. Process Zone environmental control is disclosed in Section C; personnel zone environmental control is disclosed in Section D. Also importantly, our invention generally enables optimal control for materials processing machines according to predetermined optimal control strategies, on a machine-by-machine basis; OPC is disclosed in Section E.

Those skilled in the art of materials processing will appreciate that the weaving process embodiments of our invention may be applied, in textiles, cotton ginning, yarn manufacturing, knitting, and apparel manufacture. In general, our invention represents a novel extension to most materials processing operations wherever environmental conditions in the process zone affect processing performance or whenever process zone and personnel zone environmental conditions are incompatible.

FIGS. 1 and 2 illustrate left end and front views of a modular environmental control apparatus unit 100 which provides environmental control for the process zone 60 of a weaving machine or loom 20. The MECA-1 unit 100 is shown integrated with loom 20, traveling cleaner 36, air conditioning supply ducts 30 and returns 34. MECA can operate with or without either central air conditioning or traveling cleaners.

One major difference between prior art and our invention, from which different numerous benefits accrue, is much closer proximity of capture-source elements to the process zone. Closer proximity translates into localized high volumetric exchange rate, a basic engineering concept and gas flow parameter in environmental conditioning, and which concept is employed hereinbelow to partially explain the subject invention. Closer proximity also enables more effective cleaning. Still further, closely proximate, substantially sealed process zones enable separation between or isolation of personnel work zones and machinery process zones. However, close proximity creates some problems whose solutions we also disclose.

C1. Modular Environmental Control Apparatus—weaving (MECA-1)

Figure 3C:
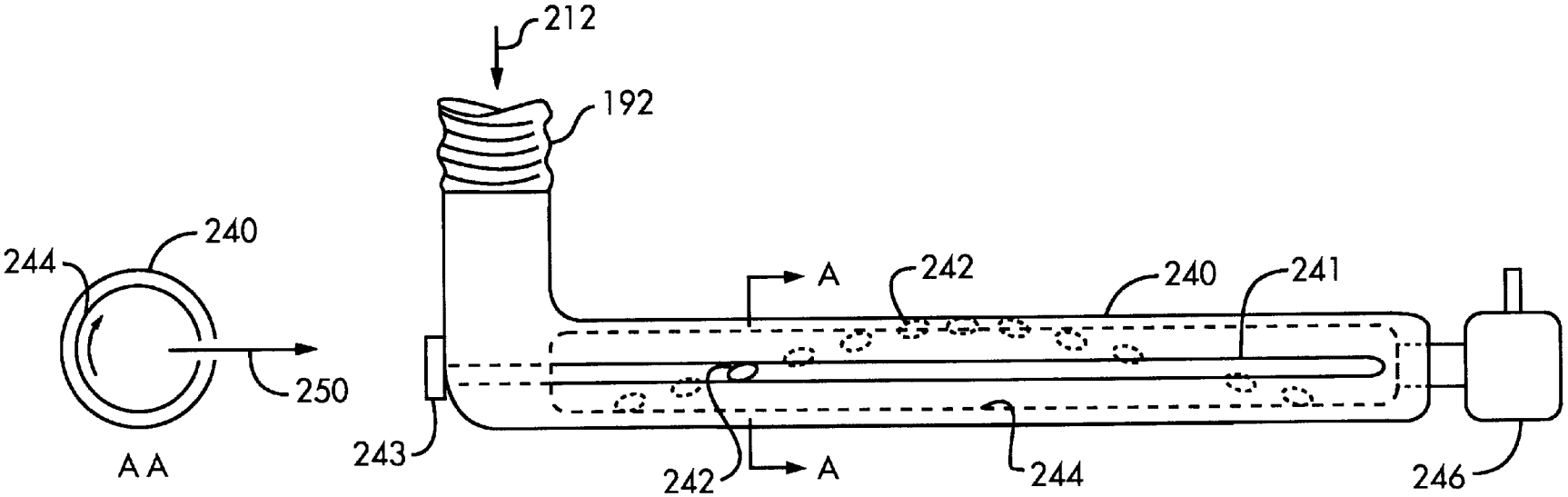
FIG. 3C depicts a scanning blow-off distributor.
Figure 3D:
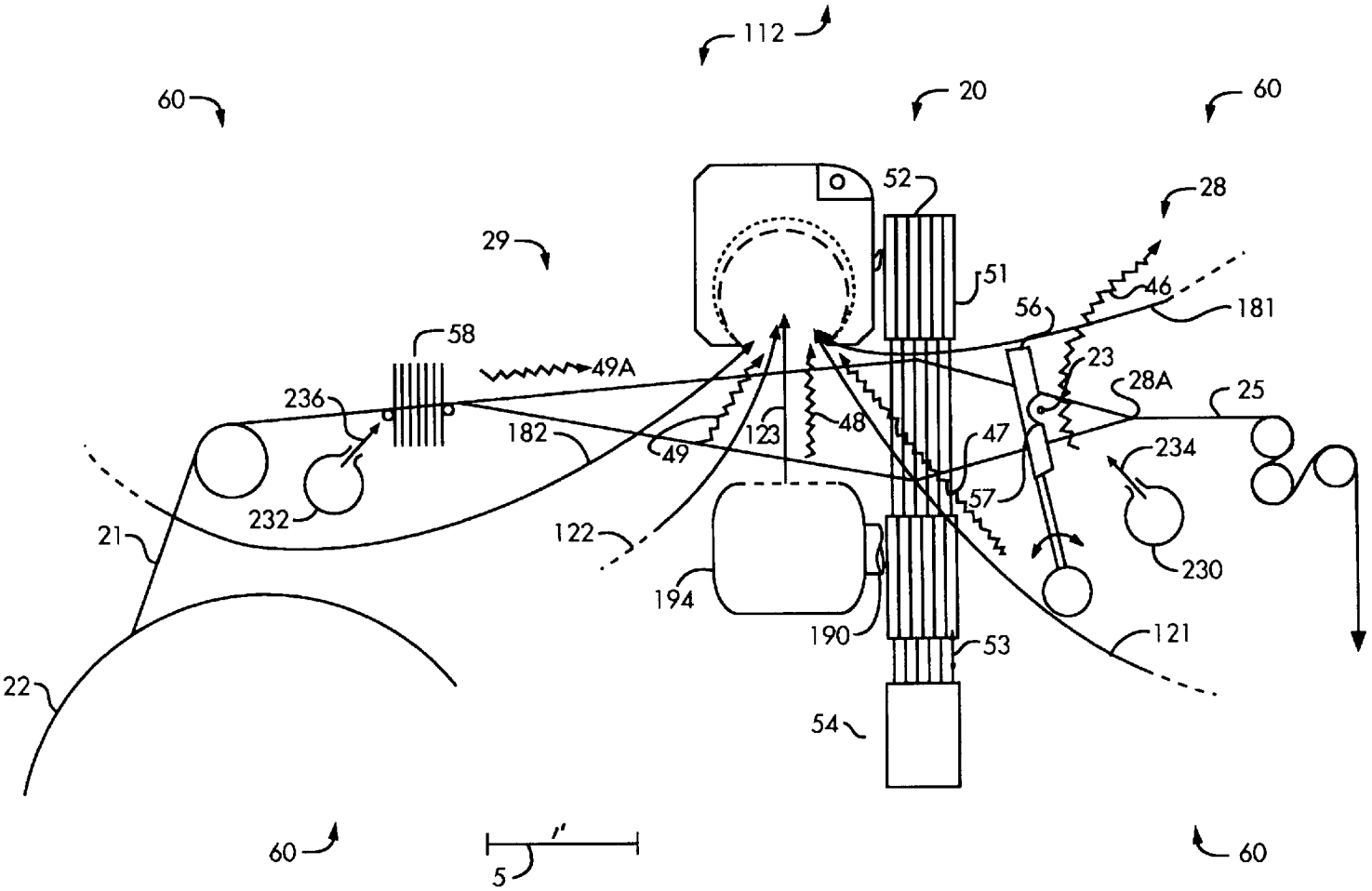
FIG. 3D is an enlarged, left-end view like FIGS. 3A or 3B but showing an alternative arrangement of gas flow elements in simplest form.
Figure 3E:
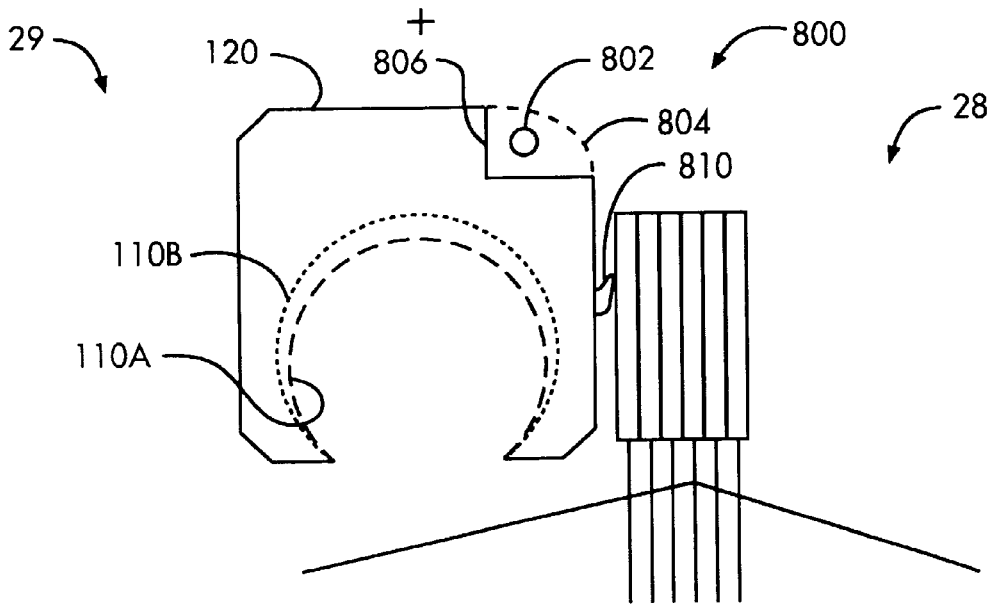
FIGS. 3E and 3F are still further enlargements of FIG. 3A showing detailed positions of gas flow elements.
Figure 3F:
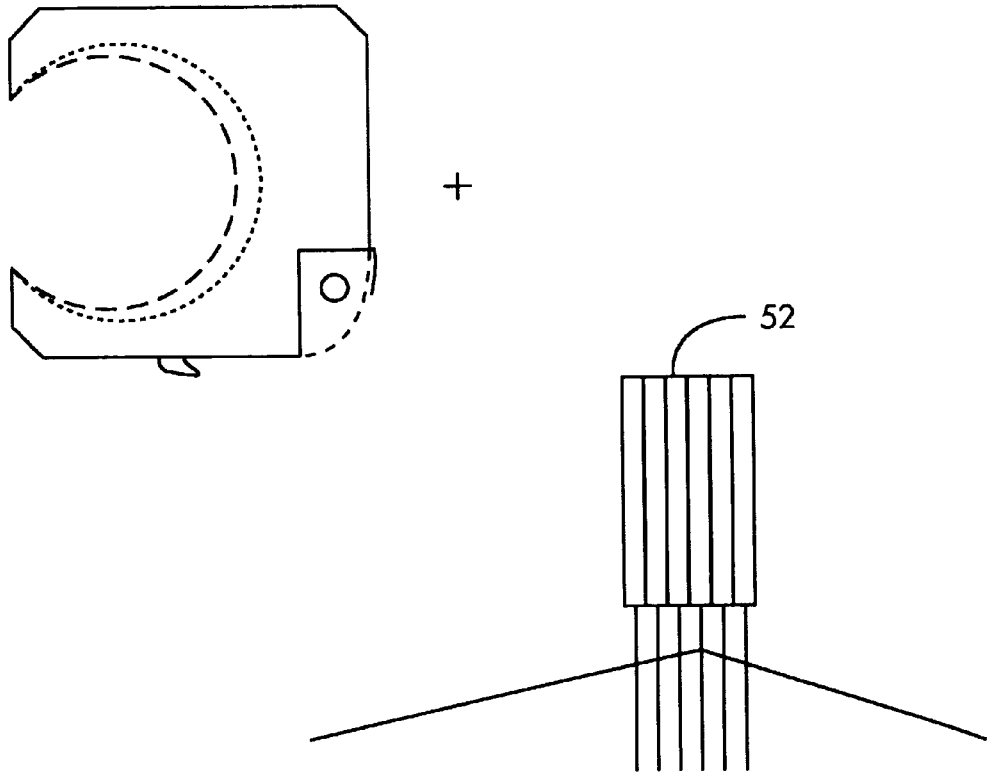
Figure 3G:
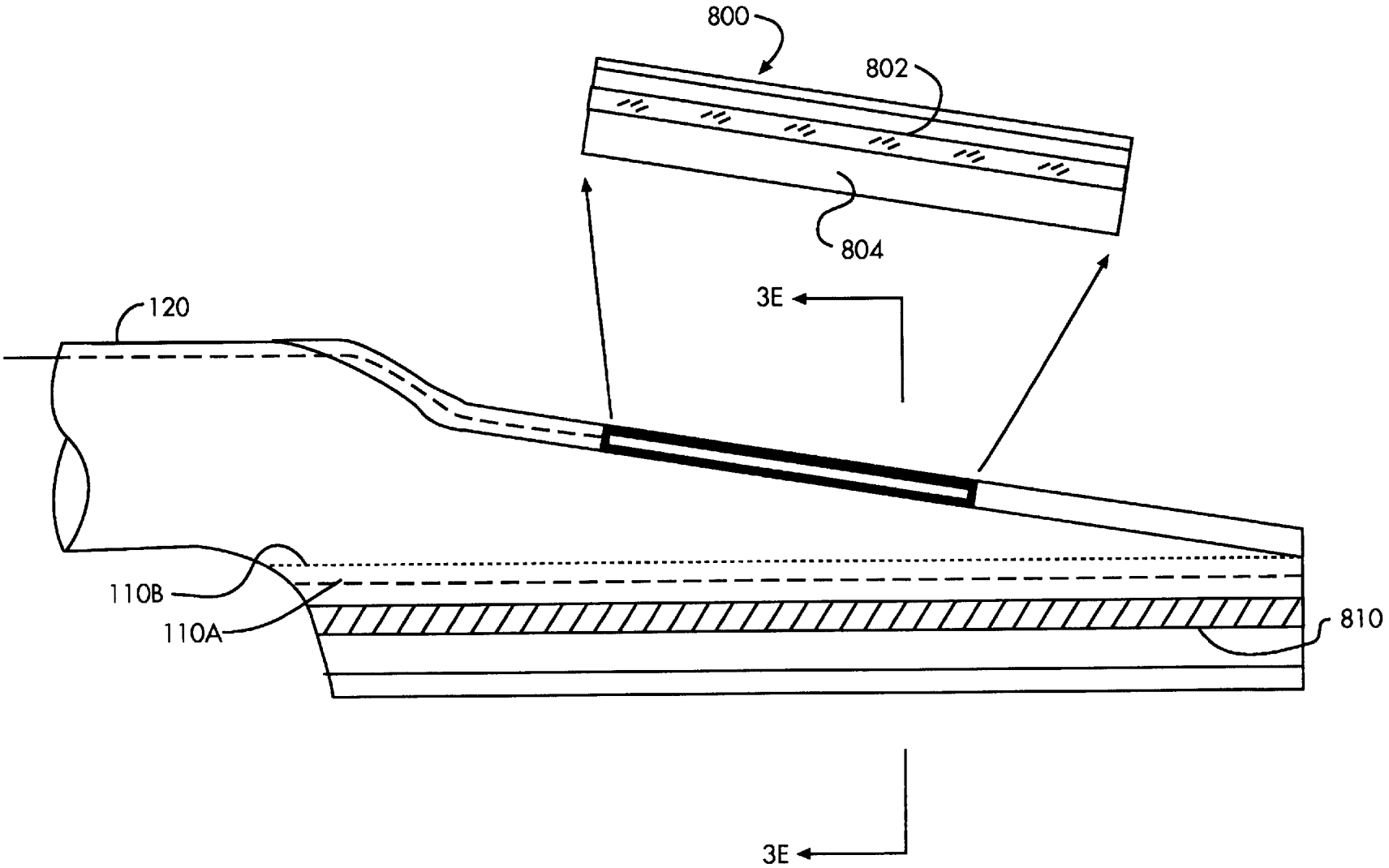
FIG. 3G is a front view of collector 120 showing various elements in greater detail.
Figure 3H:
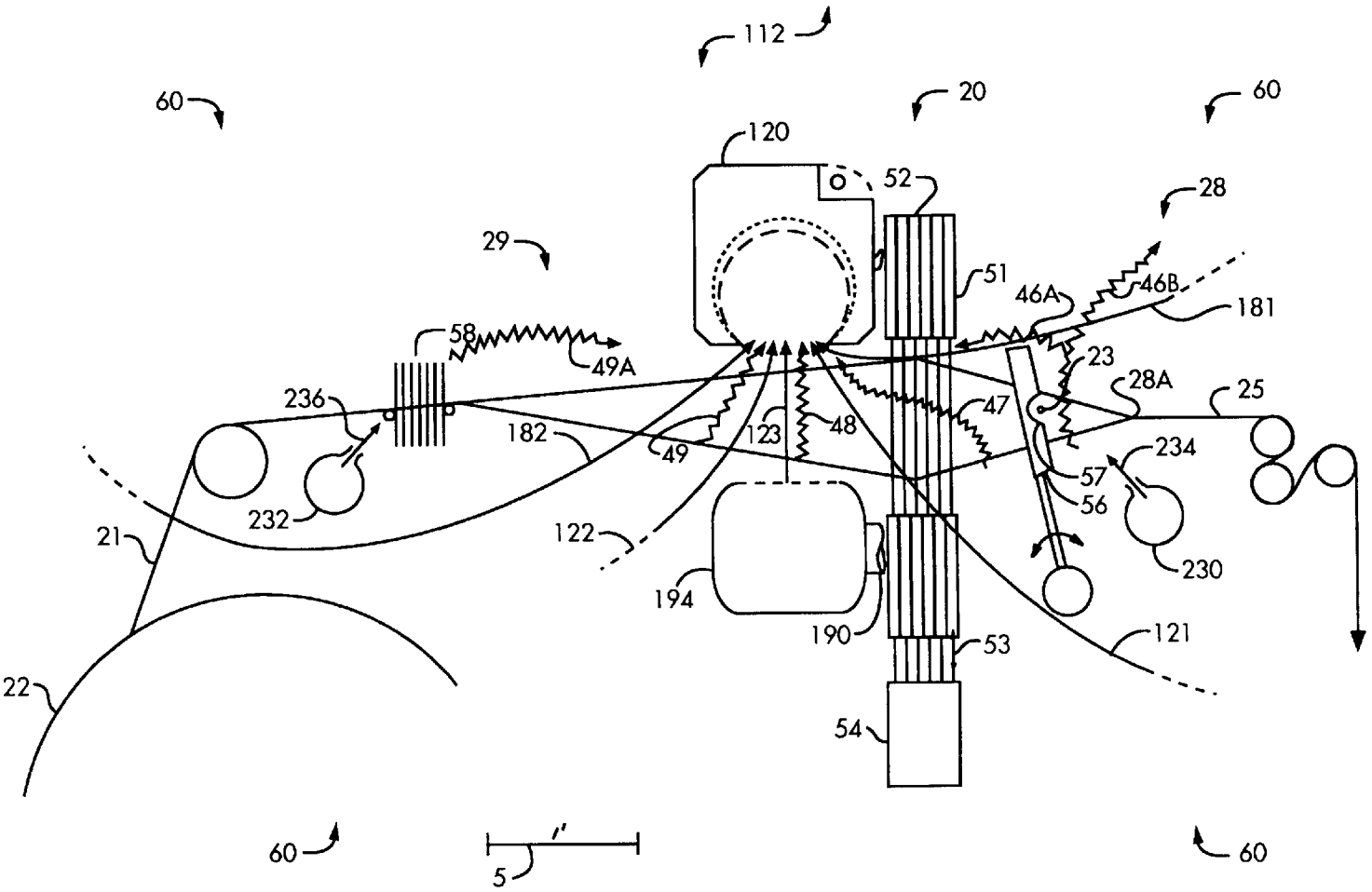
FIG. 3H is like FIG. 3D but shows details of gas flow elements and, gas flow patterns.
Figure 3J:
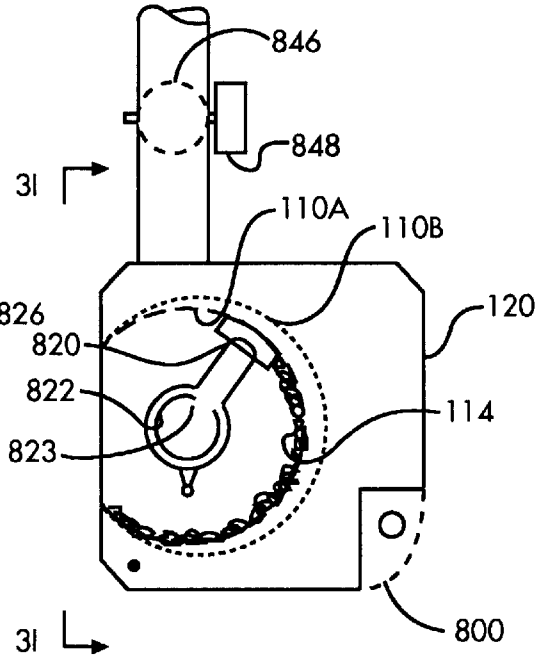
FIGS. 3I and 3J are front and right end views of collector 120 showing how automatic cleaning elements are added.
Figure 3I:
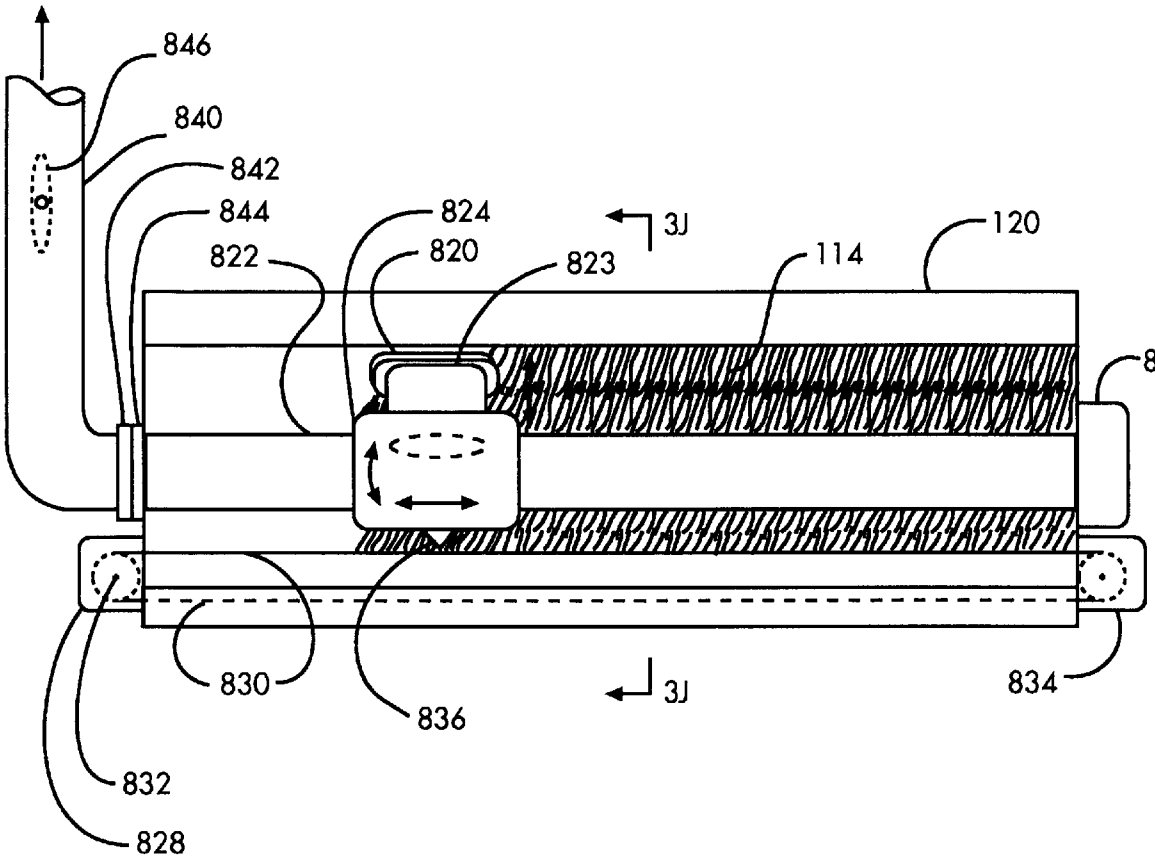
Figure 4A:
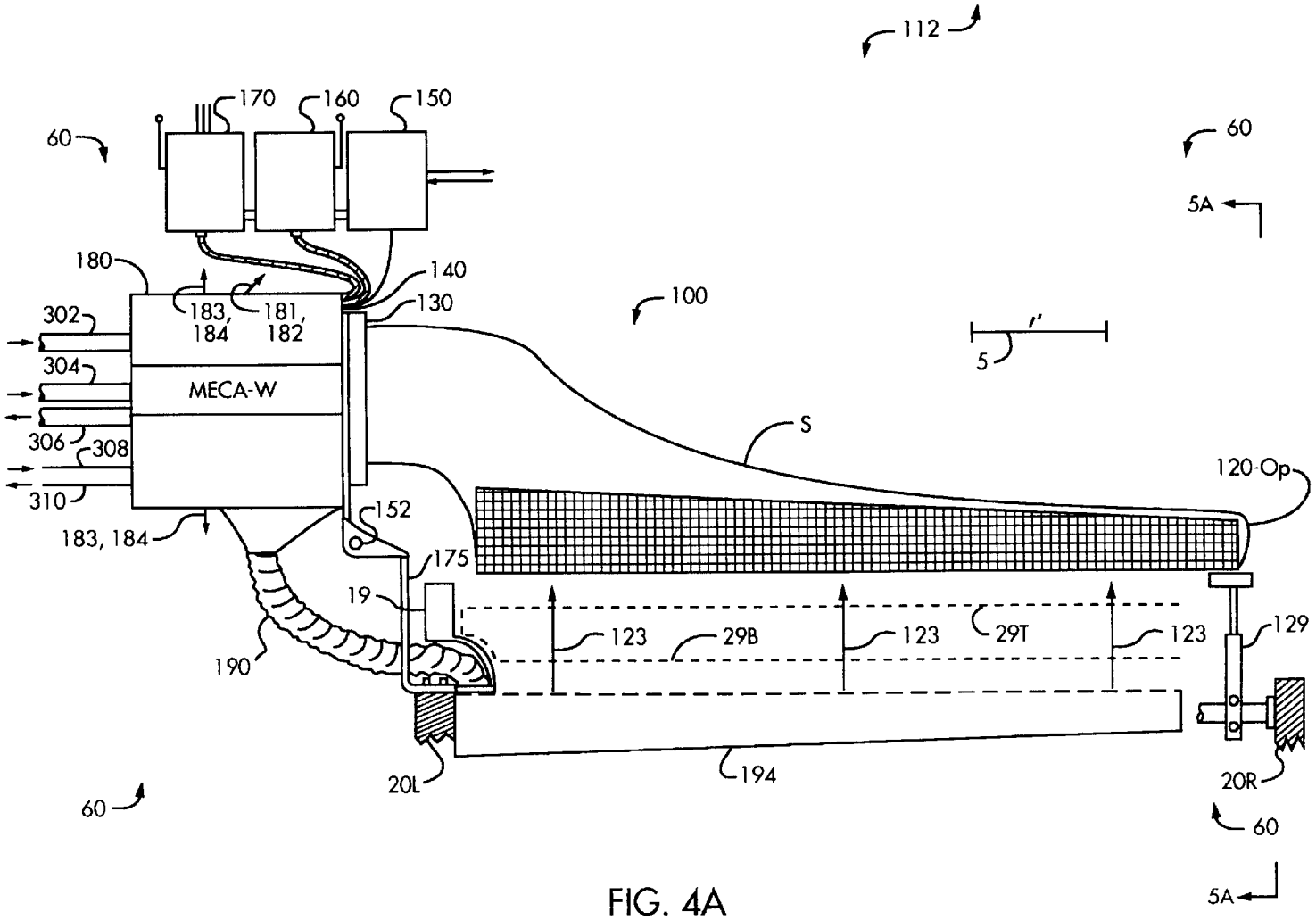
FIGS. 4A and 4B are enlarged front views of the collector and MECA unit of FIG. 2, in two different positions.
Figure 5A:
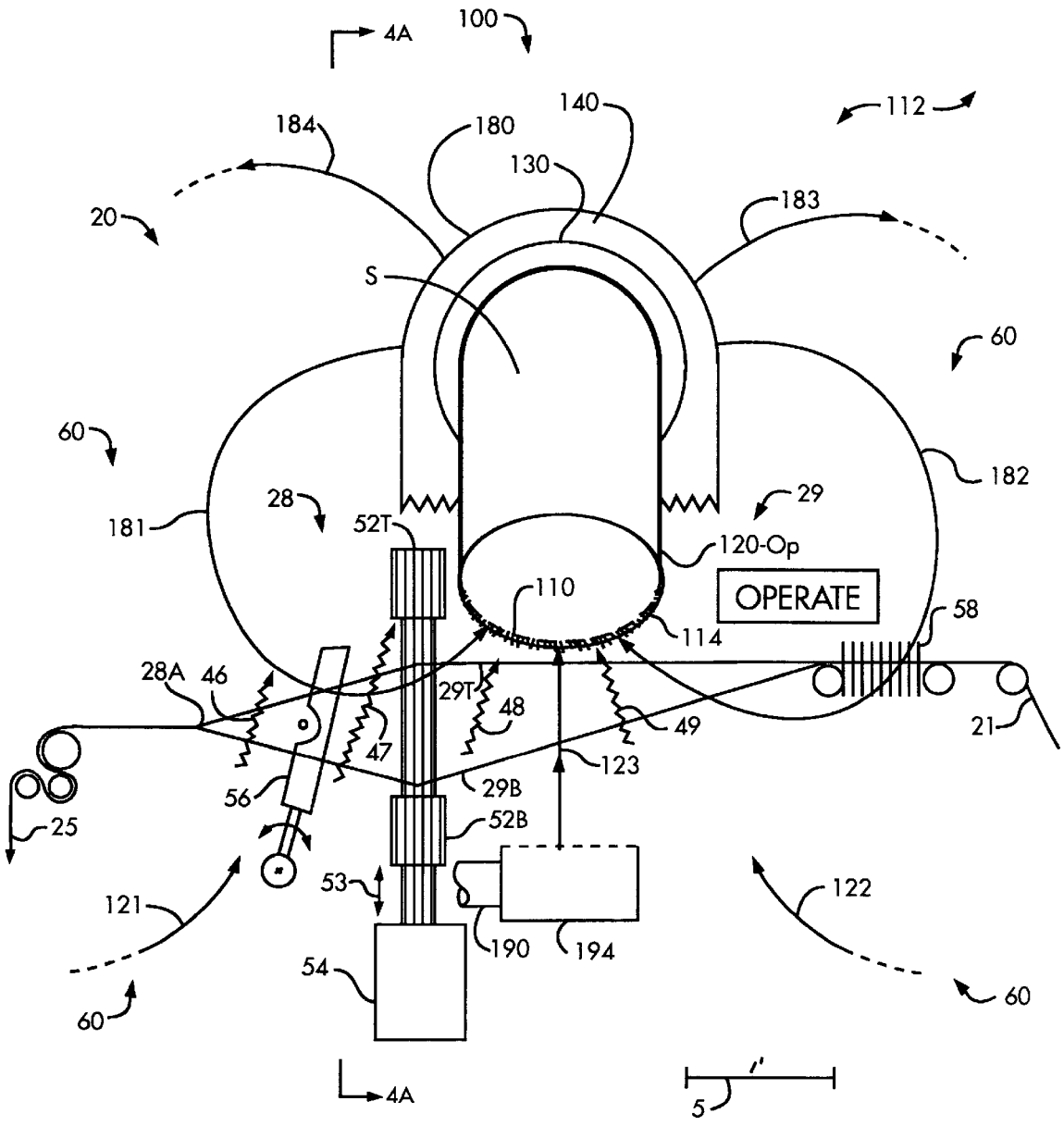
FIGS. 5A, 5B and 5C are right end views of the MECA unit of the invention in various positions taken, in the case of FIG. 5A, generally on lines 5A—5A of FIGS. 2 and 4A, and, in the case of FIG. 5B, generally on line 5B—5B of FIG. 4B.

FIG. 4A provides front view details for MECA-1 unit 100, seen first in FIGS. 1-3A. Only the loom 20 left and right end frames 20L and 20R and the top and bottom of the back shed 29T and 29B are shown for reference and scale 5. FIG. 5A is a right end view corresponding to 4A. Call-out S in FIGS. 4A and 5A is included to clarify the slope or inclination of the top surface of collector 120.

The main elements of this simplified embodiment for a self-contained, modular unit are:

110—Capture Surface(s)

120—Collector (Shown in Operate Position 120-Op in FIGS. 1-3A, 4A, 5A)

130—Collector Mount (Rotating Joint)

140—Air and Collector Drive Unit

150—Control and Monitoring Electronics

152—Collector Position/Function/Selector Switch

160—Control Power (115 VAC, 1 Φ, 60 Hz)

170—Main Power (Disconnect and Circuit Protection) (575 VAC, 3 Φ, 60 Hz);

(Other excitation voltages and frequencies may be used for 160 and 170.)

Figure 6A:
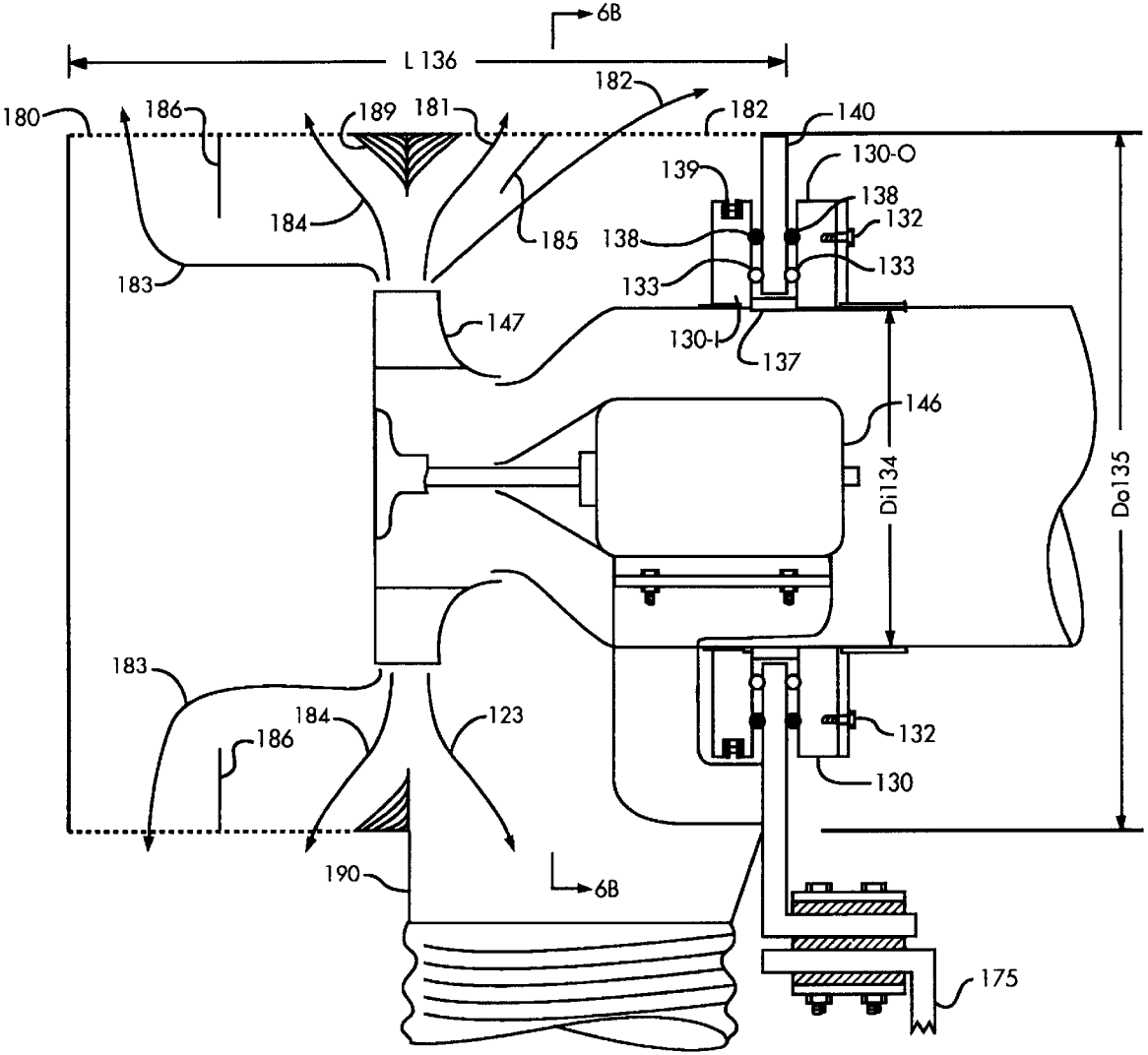
FIG. 6A is an enlarged cross-sectional view of the MECA lower unit.

175—Mounting Frame (FIGS. 4A, 6A)

180—General Source Air Diffuser

190—Directed Source Air Conduit

194—Directed Source Air Diffuser, under back shed

These representative elements are further described by their functions which enable advantageous source and capture conditions for air flow components delivered to and taken from the weaving process zone 60.

When loom 20 is in normal operation, collector 120 is in its OPERATE position 120-Op, as seen in FIGS. 1-3A, 4A and 5A. FIGS. 5A and 3A depict an "over/under", "push-pull", "blow-up", embodiment in which only one capture surface 110, over the back shed 29, captures airflow components 181, 182, 121, 122 and 123 and transports these components into collector 120. One general diffuser 180 (FIGS. 4A, 5A, 6A) provides source air components 181, 182 back towards the process zone 60 and source air components 183, 184 to the general room environment 112. Capture surface 110 in FIGS. 3A, 4A and 5A captures air flow component 123 almost completely because said flow 123 originates directly (i.e., more tightly coupled) with air from directed source diffuser 194. This capture-source air flow component 123 is delivered to diffuser 194 by conduit 190 and is driven into conduit 190 by blower 147 (FIG. 6A). All other source air components are also driven, in this embodiment, by blower 147. Dust, fibers, heat, ions, gases, etc generated (and absorbed) by the intensive weaving actions and materials in process zone 60, and which net emissions are represented in part by "wavy" arrows 46–49, mix with capture (or "sink" or "return") air flow components 181, 182, 121, 122 and 123. Dust and fibers are collected as a mat 114 on the exterior of surface 110 and are held onto surface 110 by a pressure differential of preferably about two inches water column across it. Significantly, as disclosed in Shofner U.S. Pat. No. 4,881,957, the entire disclosure of which is incorporated herein by reference, this dust and fiber mat 114 becomes a remarkably efficient filter for respirable or so-called "microdust" when the face velocity is about 200 ft per minute. The instant embodiment employs total flow of 2000 CFM and has surface area 110 of about 10 $FT^2$, so the desired face velocity is achieved. This mat can, in many cases, be easily cleaned manually, as shown in this preferred embodiment. Importantly, this mode of capture and mat formation and cleaning enables by far the most cost-effective (i.e. lowest capital and operating costs) apparatus design.

In FIG. 6A source components 181, 182 and 123 are also designated in FIG. 5A as capture components 181, 182 and 123. That is, in addition to source component 123, which is almost completely recirculated, and is thus designated source-capture component 123, other air flow components 181, 182 from diffuser 180 are captured in significant portion by capture surface(s) 110, after mixing with air flow components 121, 122 which originate from the room environment 112. For flow balance, yet other source components 183, 184 are not immediately captured but return to the room environment and can be used for personnel zone environmental control, as disclosed in Section D.

Source air diffuser 180 in FIGS. 4A, 5A causes, by internal vanes 185 or partitions 186 (FIG. 6A) air flow components 183, 184 to move more or less radially away from diffuser 180. Air flow components 181, 182 move more or less in a conical pattern back towards process zone 60 where these particular flow components 181, 182 mix with room environment air 121, 122 are captured by collector 120 and are recirculated.

FIG. 6A shows how blower 147 pushes source air 123 into conduit 190 and how said conduit 190 is integrated into diffuser 180. FIG. 1 shows how conduit 190 is connected to directed source diffuser 194.

More to the present point of functionality, in the relatively open and simple over/under, push-pull, blow-up embodiment of FIGS. 1, 2, 3A, 4A, 5A and 6A, the capture air flow components 181, 182, 121, 122 and 123, which are best seen in FIG. 5A, carry various emissions 46–49 from process zone 60 and the room 112 and are drawn through capture surface 110 and into collector 120 by fan or blower means 147 in drive unit 140. Source air 181–184 and 123, whose total volumetric rate is preferably about 2000 CFM, and which source volumetric rate is essentially identical to the volumetric rate of capture air 181, 182, 121, 122 and 123, is moved back into the process zone 60 and room 112 via general source air diffuser 180 and directed source air diffuser 194. This source air 181–184 and 123 may be filtered, cooled, humidified, ion-controlled, directed, calmed (turbulence) or silenced (noise abatement) as necessary and as further described hereinbelow, or as is well known in the art. We note now, for later reference, that the environmental conditioning (filtration, cooling, etc.) may be different for the different source air flow components, some of which move to the process zone, and others of which move to the personnel zone.

It can now be more fully appreciated that one of several novel and important features in our invention is the close proximity of source (such as 194) and capture (such as 110) gas flow elements to the weaving process zone 60. We discovered that close proximity greatly facilitates provision of effective air flow components. By close we mean, for example, less than about 2.5 feet between the bottom of collector surface(s) 110 to the top of back shed 29T.

Similarly, superior results are obtained when the top of directed diffuser 194 is less than about 2.5 feet below the bottom of back shed 29B. These specifications of "close" are consistent with the relative relationships in FIGS. 1-3A, 4A and 5A. Some of our trials have been as close as 3 inches, wherein we discovered significant improvement over our own results at thirty inches (2.5 feet) and vast improvements over the 8 to 30 source or 2.5 to 200 foot capture distances for prior art devices described above.

Proximity has some negative impacts. Interference of sheet metal or plastic components (such as collector 120) with weaving personnel (weaver, fixer, etc.) access to shed 28, 29 is one problem. We disclose in the next section novel, selectively positionable (automatically retractable) gas flow elements to overcome this fundamental problem. Light blockage and increased heat load are other problems whose solutions are discussed hereinbelow. Before these and other disclosures, however, we now conclude this section by providing alternative embodiments.

Whereas FIGS. 1-3A, 4A, 5A, 6A combine source-capture elements for various air flow components, and these elements of our invention are closely proximate to the weaving process zone, other embodiments and combinations thereof are provided by our invention. FIG. 3A discloses collector 120 with a convex collection surface 110. Concave surfaces 110A, 110B, as seen in simplified FIGS. 3D–3G, are sometimes advantageous with respect to minimizing fall-off of the dust mat, in case of power failure, or for automatic cleaning, discussed below. FIGS. 3D–3G show two filter elements 110A, 110, which surfaces are approximately cylindrical, closely proximate (less than 1" spacing), and which elements constitute first and second stages of filtration, F1 and F2. First stage filtration element 110A is preferably 32×32 plastic mesh known as "saran screen" which is easily cleanable, manually or automatically. 32×32 means 32 strands per inch, in both directions. Second stage filtration element 110B is preferably a medium permeability, high efficiency fabric filter which is known in the art as "fake fur."

FIGS. 3D–3F also reveal illumination means 800 comprising linear fluorescent light bulb 802, transparent shield 804, and reflector/housing 806. Said illumination means 800 offset light blockage or shadowing of collector 120 and, significantly, enables very bright, better coloration light to be applied to process zone 60 or, more specifically, to shed 28, 29 for the small percentage of time when it is most needed. That is, light 802 is only on when loom 20 is stopped, collector 120 is in selectively positionable RETRACT position 120-R (FIG. 3F), and the weaver is attending to repair of a broken warp yarn in shed 28, 29, for example.

FIGS. 3E and 3G also indicate seal 810 which minimizes air flow between collector 120 and harness frame 52. This sealing action increases collection of air flow components 181 and 121, best seen in FIG. 3H, and thereby, enables better collection of process zone emissions 46, 47.

FIG. 3B is seen to correspond to FIG. 3H. The former uses a collector 120 with convex surface 110 and the latter uses a collector 120 with concave surfaces 110A, 110B. Convex surfaces 110 are preferred for low ratios of dust collection, less than about one pound/day, where manual cleaning is feasible. Concave surfaces 110A, 110B are preferred for high rates, more than about one pound/day, where automatic cleaning is justifiable. Note the improved capture of emissions components 46, 47 in FIG. 3H versus FIG. 3B. This improvement results from inherently closer proximity of collector 120 to the shed 29 and from seal 810.

We now disclose our means for automatic or semi-automatic cleaning filter elements 110A and 110B. FIGS. 3I and 3J describe filter elements 110A and 110B having concave surfaces with dust mat 114 collected on surface 110A. Not shown is fine dust collected on or better in fabric filter 110B, which dust arrived at second stage filter 110B because it was not collected by first stage filter, primarily the dust mat 114, according to Shofner-957. Dust mat 114 on surface 110A and the unshown dust in surface 110B are removed by the next-described cleaning means.

Stripping nozzle 820 is rotably and linearly scanned over surface 110 by rotation of pipe 822 and linear movement of stripper head 824. Said rotary motion is driven by reversible gearmotor 826 and said linear motion of stripper nozzle 820, attached to stripper head 824, is driven by gearmotor 828 operating on cable loop 830. Cable loop 830 is carried on pulley 832 which is driven by reversible gearmotor 828, and on idler pulley 834, and imparts force to stripper head 824 by clamp 836. As illustrated in FIGS. 3I and 3J, dust mat 114 is removed by next-described suction means, leaving clean surface 110A. Unshown dust in fabric filter 110B is also removed. Connecting hole 823 between nozzle 820 and tube 822 may be implemented with a suction version of FIG. 3C (described below) with flexible tubing, or in numerous ways known in the art.

Strong suction, about 20 inches water column, or in some cases, very strong suction, about 10 inches mercury column, are applied to suction nozzle 820. This suction collects dust mat 114 and also releases and transports unshown dust in fabric filter 110B back through first stage filter screen 110A. Removal of this latter dust is facilitated by spacing surface 110B less than about one inch from the back side of surface 110A. Unshown dust release from filter element 110B may be further facilitated by well known vibratory or compressed air jet means.

Cleaning air flow, having the aforementioned strong or very strong suction and transporting the dust released from filter elements 110A and 110B, is carried by tube 822 into tube 840 and thereby to a central system which provides said cleaning flow vacuum and means for handling the dust collected. Such waste-handling systems are well known and are commonly used with central air conditioning systems described in FIGS. 1 and 2 and in the specifications thereto related.

Sealing flanges 842, 844 and valve 846, driven by actuator 848 comprise further elements for automatic or semi-automatic cleaning. In automatic mode, collector 120 moves to cleaning position 120-C where sealing flanges 842, 844 engage. Valve 846 is opened by actuator 848 and nozzle 820 scanning is initiated. After filter elements 110A, 110B are cleaned, the steps are reversed and the MECA returns to service.

To illustrate one semi-automatic cleaning mode, collector 120 is positioned by hand control (described later) to cleaning position 120-C and suction valve 846 is opened manually and suction nozzle 820 is scanned manually.

Another alternative configuration for process zone environmental control is to omit directed source diffuser 194, as seen in FIG. 3B. All source air is thus provided from general diffuser 180 which then operates in combination with capture surface(s) 110. (Source or blow-off elements 230, 232 are explained later.) This results in a simpler, more self-contained, modular design which is particularly suited for retrofit installations. Note that this configuration actually increases the flow of room air components 121, 122 in the weaving process zone 60.

In such configurations, significant further benefit for both process zone and personnel zone environmental control may be realized if conduit 190 (FIG. 1) is arranged to deliver air flow 123 (FIG. 6A) directly to underfloor return 34. In some cases, air flow 123 advantageously becomes most or all of the air flow captured by collector 120. The ultimately simplest, lowest cost configuration is to remove filtration elements 110, 110A, 110B and to blow all of the air captured by them into underfloor return 34 or into return air ductwork installed specifically for this purpose (not shown but identical in function to underfloor tunnels described above). In this embodiment, substantially all of the MECA heat load and most of the loom heat load are removed from the process and personnel zones. And the waste handling problem of cleaning dust mats 114 from collector 120 is shifted to the central air conditioning system. Of course, this simplest and lowest operating cost necessitates a central system with adequate capabilities.

Another combination is to stationarily position capture surface(s) 110 well above 2.5 feet, for example, over the weaving process zone 60 but to retain the closely proximate directed source diffuser 194 and general diffuser 180. This design has the advantages of non-interference and collecting cleaner, cooler, moister air from the room environment 112 into collector 120 and sourcing it via diffusers 180 and 194 into process zone 60.

This last combination illustrates simplifications in the direction toward less tightly-coupled configurations. In the other direction, toward more tightly-coupled configurations, it is advantageous to recirculate more air immediately back into capture element(s) 110 in relatively more tightly coupled and more complex designs described in further embodiments of our invention hereinbelow. More tightly coupled designs enable high (100s/HR) to very high (1000s/HR), local air exchange rates, among other advantages which offset their increased complexity.

Before disclosing further configurations, we next describe how capture or source elements of our invention can be selectively positioned, from closely proximate to process zone 60 to conveniently retracted out of the way, thus solving the most fundamental problems mentioned above which results from close proximity.

C2. Positionable Collector: Operational Functions

Figure 4B:
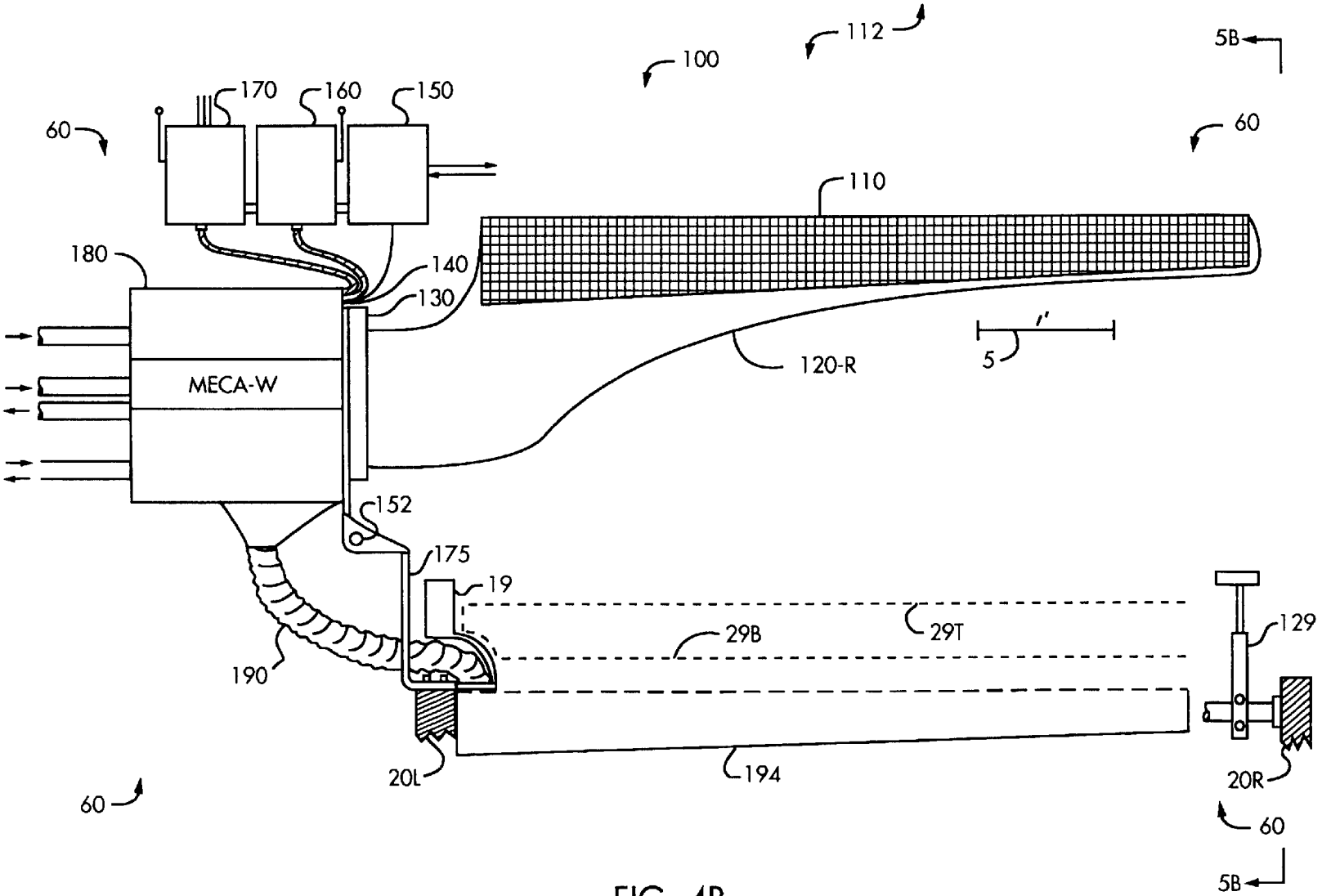
Figure 5B:
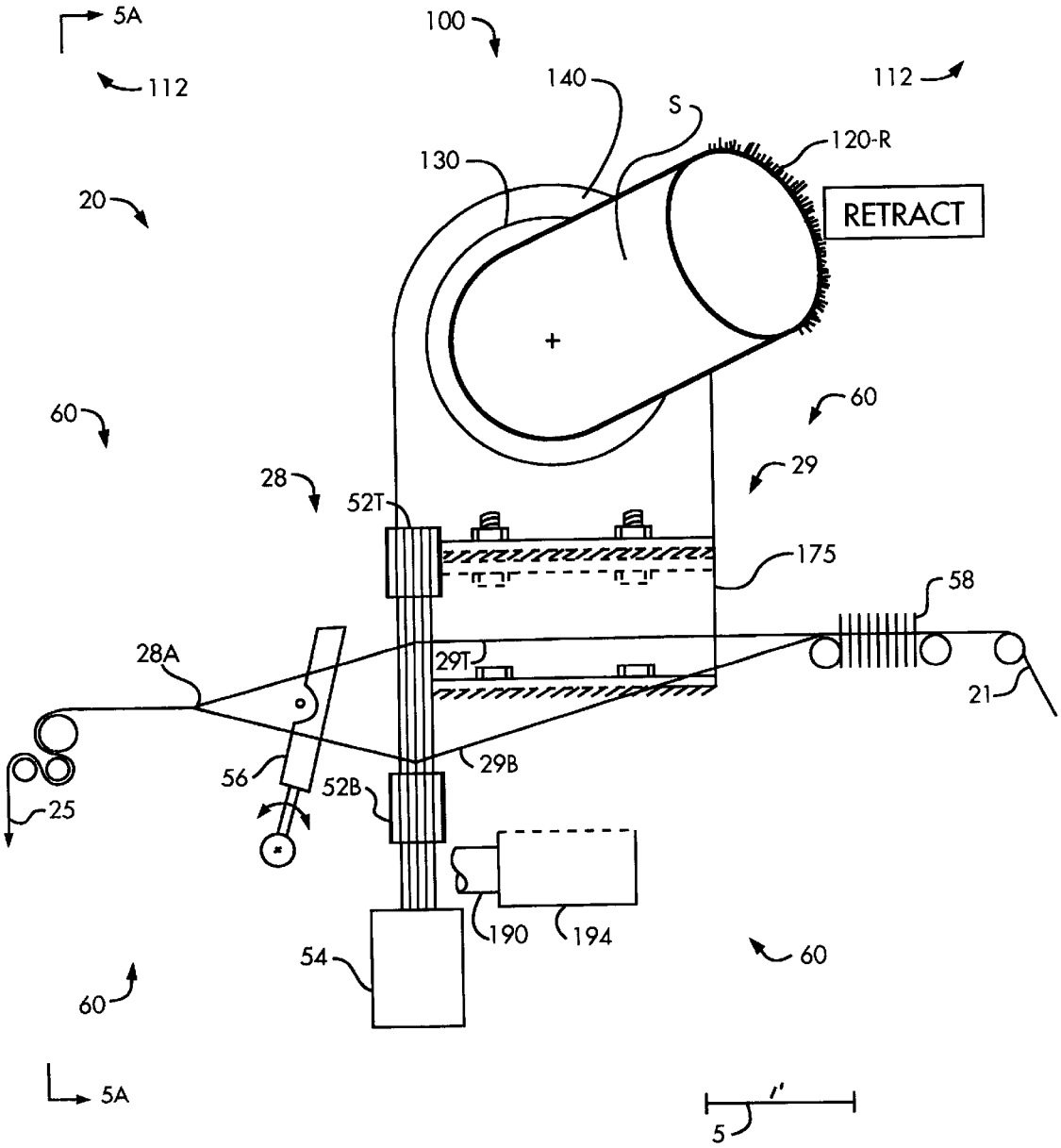
Figure 5C:
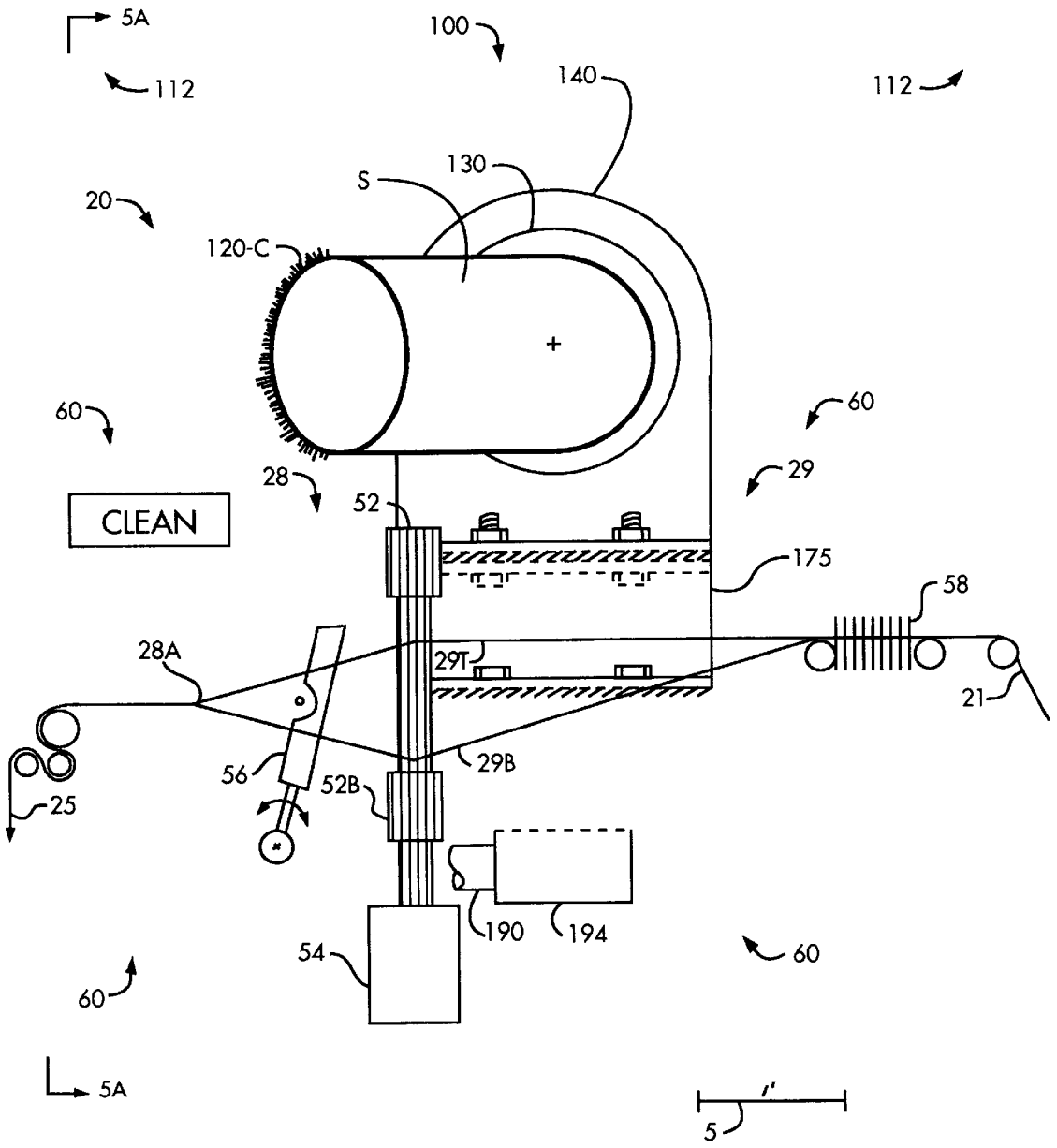

When loom 20 is not in normal operation, in some cases collector 120 must be re-positioned (rotated counter-clockwise in the orientation of FIGS. 5A, 5B and 5C) to RETRACT position 120-R depicted in FIG. 4B and 5B. Collector 120 is supported and driven by collector mount 130 seen in FIGS. 4B and 5B and which consists of a ball bearing outer ring assembly 131-0 seen in more detail in FIG. 6A. Collector mount 130 must freely move and be very structurally sturdy to withstand the large cantiliver or overhung load presented by collector 120 when it moves off rest 129 (FIGS. 4A, 4B). In most cases, the rest is not required.

Collector 120 attaches to outer ring 131-0 by means of bolts 132 (or by quick-connect devices, not shown) and is supported and rotated thereby. Robust support and low friction rotation are enabled by 48 steel balls 133, 0.5 inch diameter, in each of the inner and outer races for them machined into rings 130-0 and 130-I and, correspondingly, frame 175. Mounting frame 175 is preferably 0.5 inch thick steel and rings 130-0, 130-I are preferably 0.75 inch thick× 1.5 inch width steel. In preferred embodiments for which capture air volumetric flow rate is about 2000 CFM, the inner diameter $D_i$134 of collector 120 at collector mount 130 is about 14 inches, the outer diameter $D_o$ 135 of diffuser 180 is about 20 inches, and length L 136 of diffuser 180 is about 20 inches.

Figure 6B:
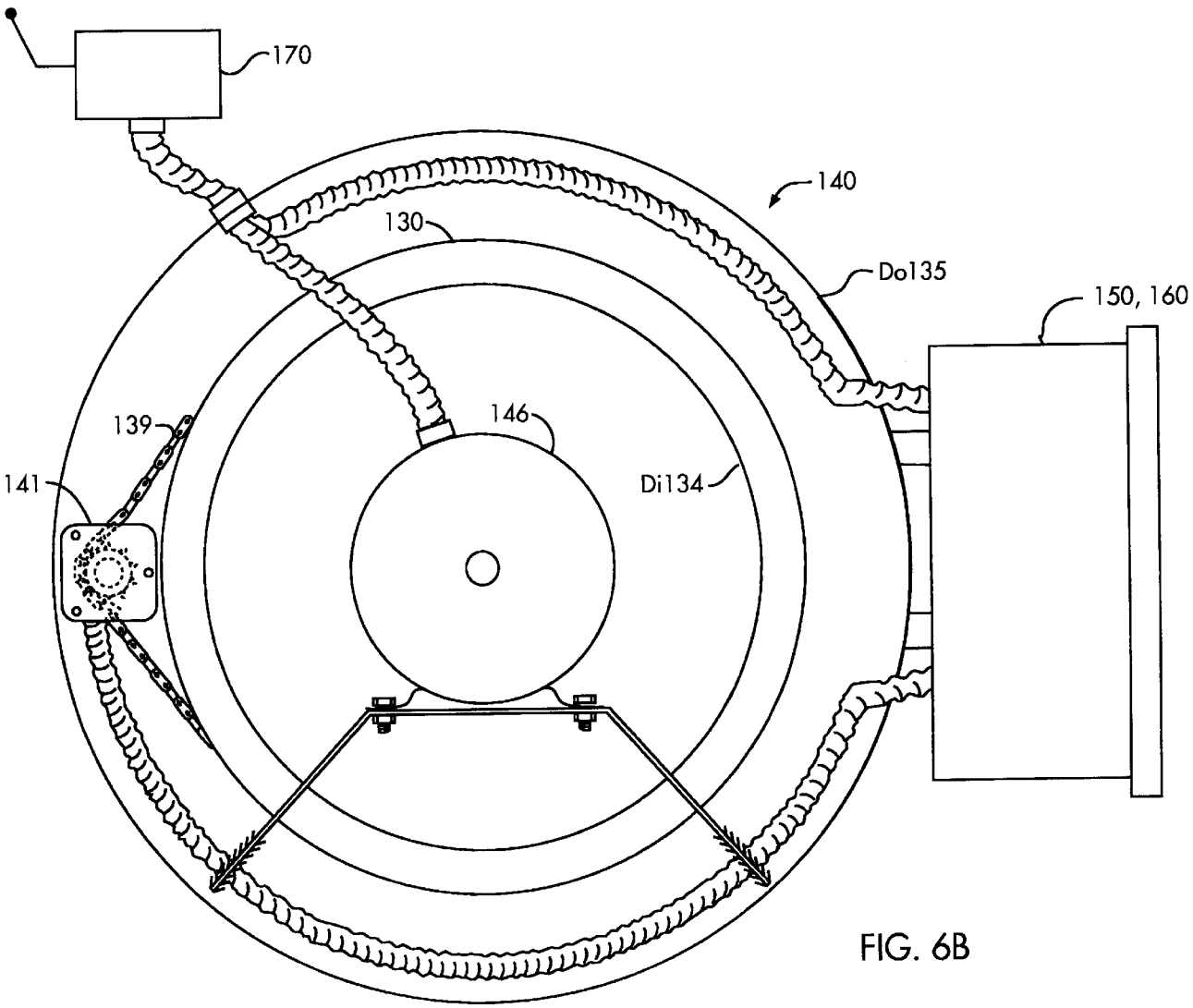
FIG. 6B is a section on line 6B—6B of FIG. 6A.

Inner and outer rings 131 are held together by bolts (not shown) into spacer ring 137. Balls 133 are conventionally lubricated with a medium viscosity grease and are protected from contamination with elastomer seals 138. In particularly dirty environments, felt or metal shields (not shown) are used to keep dust and fibers away from seals 138. Chain 139 (FIGS. 6A, 6B) couples the dual ring, collector mount assembly 130 to gear motor 141 (FIG. 6B). During movement between the OPERATE, RETRACT and CLEAN positions, the collector mount has a rotational velocity of preferably about 1.5 revolutions per minute. Reversible gear motor 141 is controlled by control and monitoring electronics 150, shown as a separate unit in FIG. 4A and mounted above drive unit 140. FIG. 6B shows control power 160 and control and monitoring electronics 150 combined within a single enclosure 150, 160 which is mounted on collector drive unit 140.

Figure 7A:
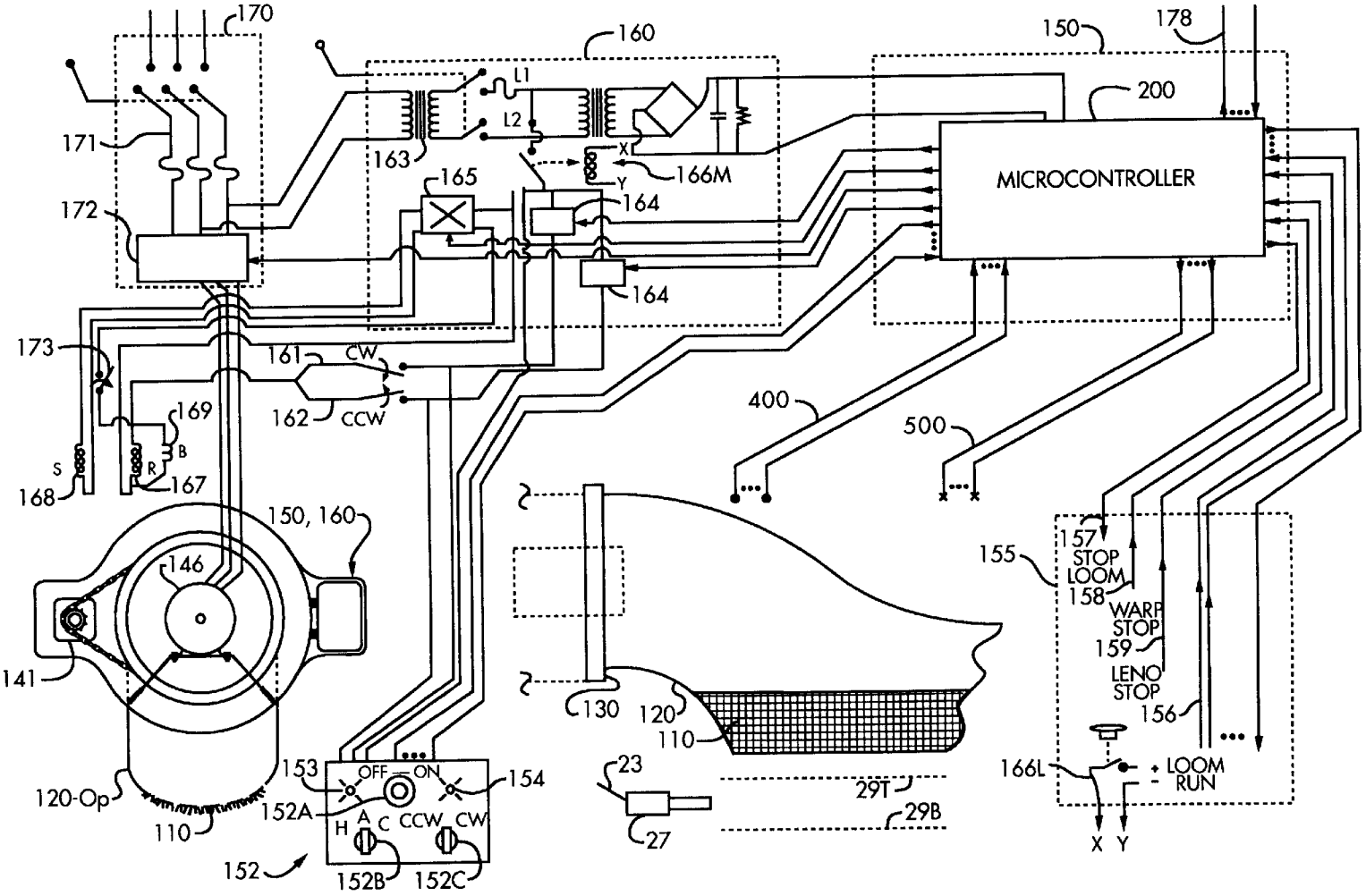
FIG. 7A depicts in highly schematic form a microcontroller-based control system of the subject invention.

Two cases will illustrate an automatic RETRACT function. First, if any one of the warp ends 21 in FIGS. 3A or 5A breaks, the drop-wire stop motion 58 will stop loom 20. In FIGS. 6B and 7A, MECA-W electronics 150 receive two signals from loom electronics 155, warp stop 158 (12 changing to 0 volts, seen across shorting bars within stop motion 58) and LOOM NOT RUN 156 (opening of dry contacts). When both conditions exist, microcontroller 200 or other electronics means causes gear motor 141 to drive collector 120 from OPERATE position 120-Op (FIGS. 4A, 5A) to the RETRACT position 120-R (FIGS. 4B, 5B), in about fifteen seconds, where it remains until the broken warp yarn end 21 is repaired by the weaver. When the repair is finished, the weaver restarts loom 20. Microcontroller or other electronics 200 recognizes that all warp yarn ends 21 are intact (12 volts at input 158) and that the loom is running 156 (closure of LOOM RUN dry Contacts). After a user-settable delay, typically of ten seconds, microcontroller 200 causes collector 120 to rotate clockwise until it again reaches OPERATE position 120-Op (FIG. 5A), where collector 120 remains until another stop occurs which requires retraction.

As the second illustrative example, one such other stop is a "Leno" stop motion 159. The Leno apparatus 19, shown only in FIGS. 4A and 4B, enables formation of a better selvage for the woven cloth and is located near and behind harness 52 but in front of warp stop motion apparatus 58. Left 19 and/or right (not shown) Leno apparatus are used, depending on the fabric being woven. Free access to correct Leno 19 stops also necessitates rotation of collector 120 to RETRACT position 120-R. The signals 159, 156, logic, and microcontroller 200 actions to this stop, its repair, and to loom restart are identical to the warp stop case just explained above.

Other loom stops do not necessarily require automatic movement to RETRACT and return (after delay) to OPERATE positions. Stops related to failure to insert filling yarn 23 correctly also stop the loom and provide annunciation for the weaver. But in these cases, repair is made in front of harness 52, in front shed 28, to filling yarn deliveries 26 or packages 24, to the right selvage, etc., and collector 120 can remain in OPERATE position 120-Op.

As seen in FIG. 7A, the automatic control functions of microcontroller 200 can be overridden by moving mode selector switch 152B from AUTO (A) to HAND (H) position. The operator can then cause gear motor 141 to move the collector from OPERATE (fully CW in FIG. 5A) to CLEAN (C) (fully CCW in FIG. 5C) by means of momentary rotation direction switch 152C. HAND movement of collector 120 is used when major loom changes or repairs are required, or when it is desired to move to CLEAN position 120-C (FIG. 5C) under HAND control.

HAND (or AUTOMATIC) movements beyond fully CCW (CLEAN 120-C) or fully CW (OPERATE 120-Op) are precluded by customary limit switches 161, 162 in FIG. 7A. However, if limit switches 161, 162 fail, strong mechanical limits stop any further movement after the shearing of an unshown break-away or torque-limiting pin in inner ring 130-I which engages chain 139 (FIG. 6B).

Unattended movement to CLEAN 120-C may be realized by placing MODE switch 152B to CLEAN and pulling mushroom switch 152A fully out, momentarily. Momentary contacts in switch 152A cause microcontroller 200 to rotate to CLEAN position 120-C, at which position CCW limit switch 162 stops rotation. This motion is also achievable with remote initiation via microcontroller 200 communication interface 178 to external computer or control electronics.

Collector 120 is rotated to CLEAN position 120-C (FIG. 5C) for removal of dust and fibers from capture surface 110. This removal is preferably by hand when less than about one pound of total dust is captured on capture surface 110 in 12 hours of processing denim. Following the manual cleaning step, which takes less than 10–15 seconds, typically, mode switch 152B is moved to AUTO (A) and collector 120 rotates, after a delay of preferably ten seconds, toward OPERATE position 120-Op (FIG. 5A). Travel time from CLEAN 120-C (FIG. 5C) to OPERATE 120-Op (FIG. 5A) is about thirty seconds.

A brief overview of the main and control power elements 170, 160 in FIG. 7A completes our disclosure of blower motor 146 excitation and microcontroller-based MECA collector 120 motion control. Three phase power, preferably 575 volts AC, 60 Hertz in the United States or 380 V, 50 Hz in Europe, for example, is delivered by disconnect and circuit protection 171 to variable frequency converter 172 and then to blower motor 146. One phase of this electrical power is carried from main power box 170 to control power box 160, where single phase control power, 115 VAC, 60 Hertz, is developed by control transformer 163. This power is then used to supply gear motor 141 via well-known and conventional solid state relays 164 and dry contact relay 165. Relay element 165 is a reversing relay which enables gear motor 141 to rotate CW or CCW. Gear motor 141 is preferably a split phase alternating current motor having running coil 167, starting coil 168, and brake coil 169. Thermal switch 173 disconnects starting coil 168 excitation, via reversing relay 165, after the motor 141 is up to speed. Other control power voltages, including DC and control components, are well known in the art and may be used. Pneumatic (described next) or hydraulic means can also be used.

Special notes are made in reference to frequency converter 172 and lock-out relay 166. Converter 172 is controlled by microcontroller 200, by other computer means, or manually. This enables controlling the pressure and/or flow performance of blowers 147, 148 (FIGS. 6A, 6C) according to optimal control strategies to be discussed later. Lock-out relay 166 assures safety. Relay 166M coil is excited only when the loom lock-out switch 166L is in ON. This means that when the loom 20 motion is locked out, so is motion of MECA collector 120.

It will be appreciated that microcontroller 200 in FIG. 7A enables powerful (meaning broadly flexible, accurate, fast and cost-effective) control of collector 120 motion or of the various environmental and process variables or parameters (inputs 400, control outputs 500). For example, microcontroller 200 enables almost arbitrary collector 120 positioning or precise control of humidity in one source air flow component, such as flow component 123 in FIG. 6A.

For applications where collector 120 position simplifies to being in or moving between OPERATE 120-Op (FIG. 5A) or RETRACT 120-R (FIG. 5B) and cleaning is performed in Retract, or where no or minimal control of environmental variables is required, a much-simplified control system is preferable, as next described.

Figure 6C:
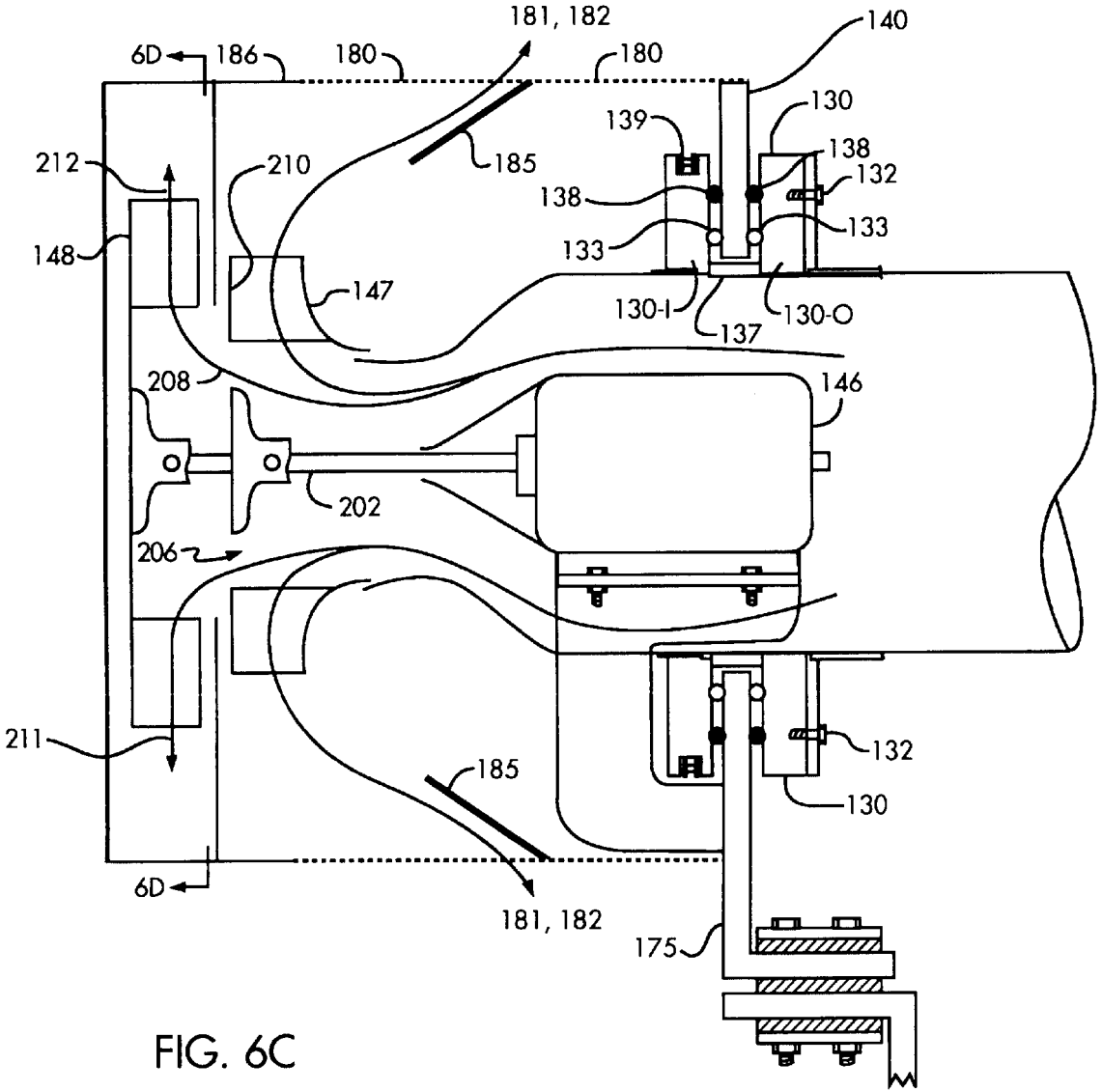
FIG. 6C is a view similar to FIG. 6A, of a modified embodiment.
Figure 6D:
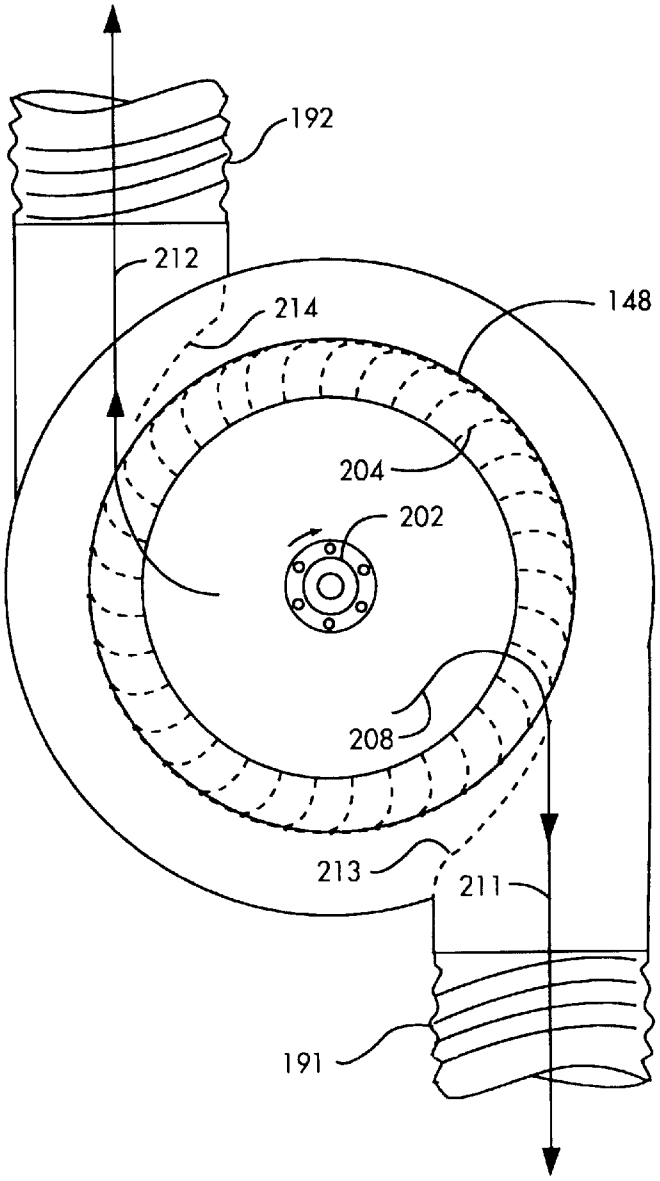
FIG. 6D is a view taken on line 6D—6D of FIG. 6C, showing the blower wheel.
Figure 6E:
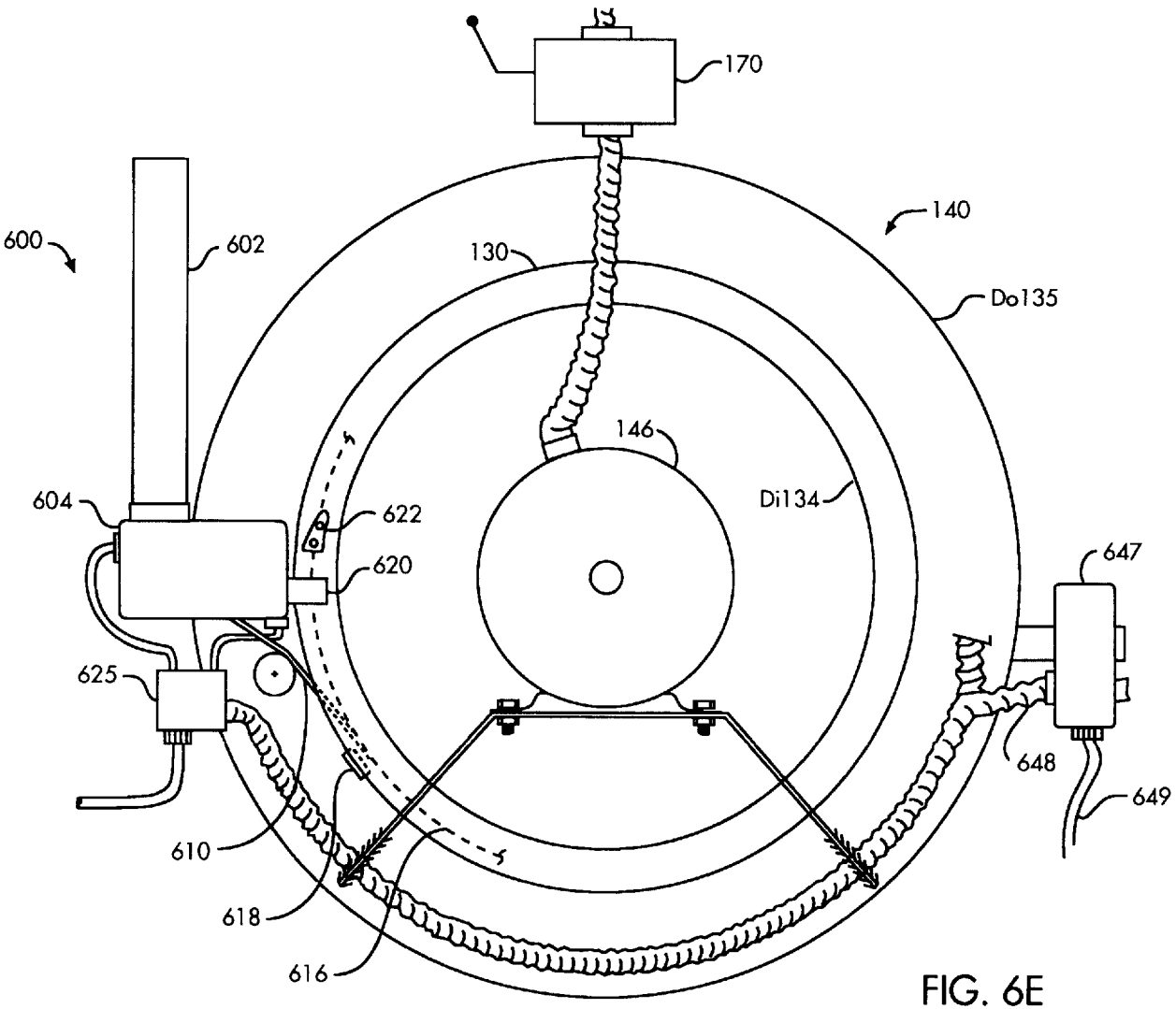
FIG. 6E is similar to 6B but shows alternative collector drive system.
Figure 6F:
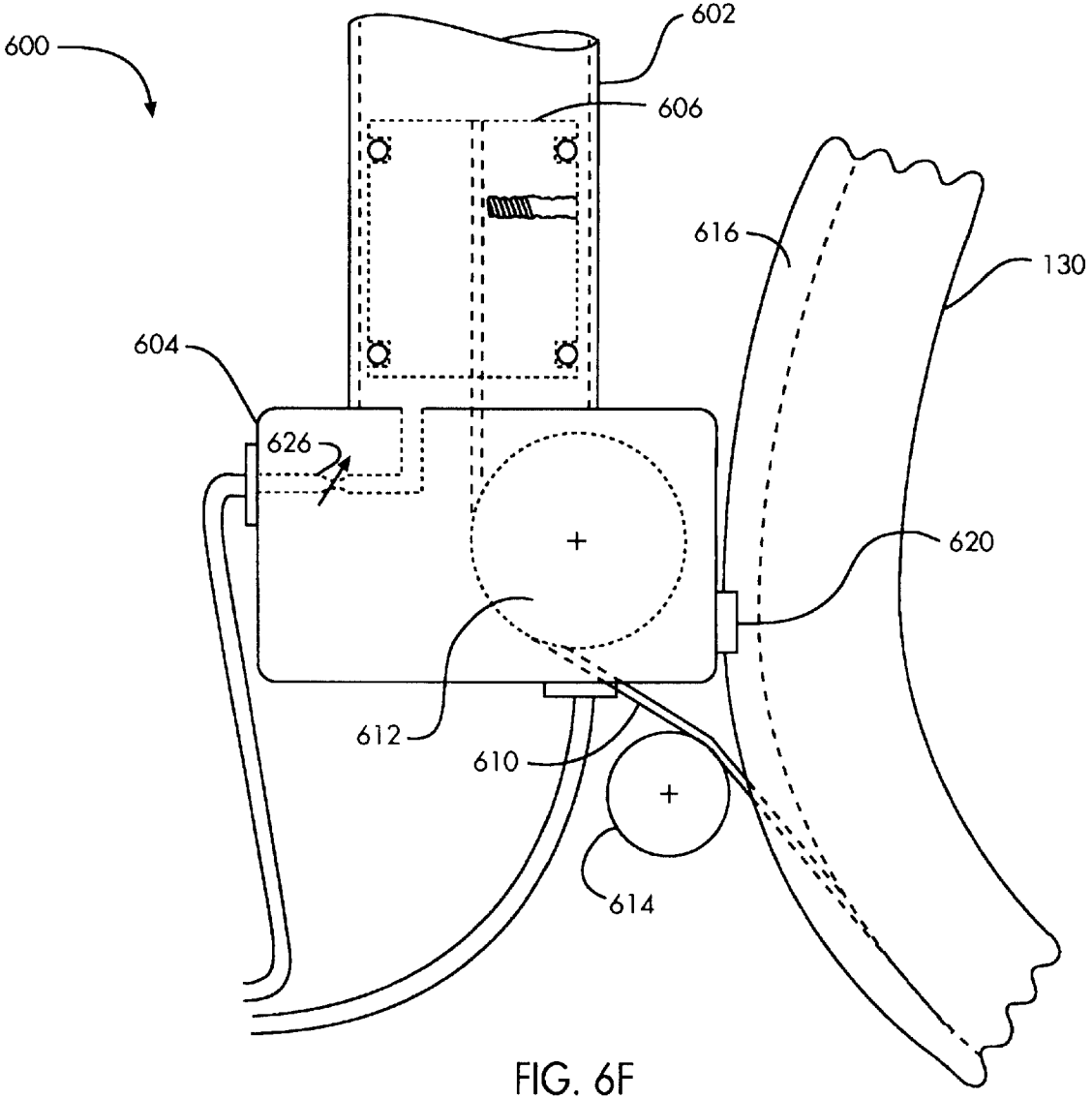
FIGS. 6F and 6G show enlarged detail for pneumatic elements of FIG. 6E.
Figure 6G:
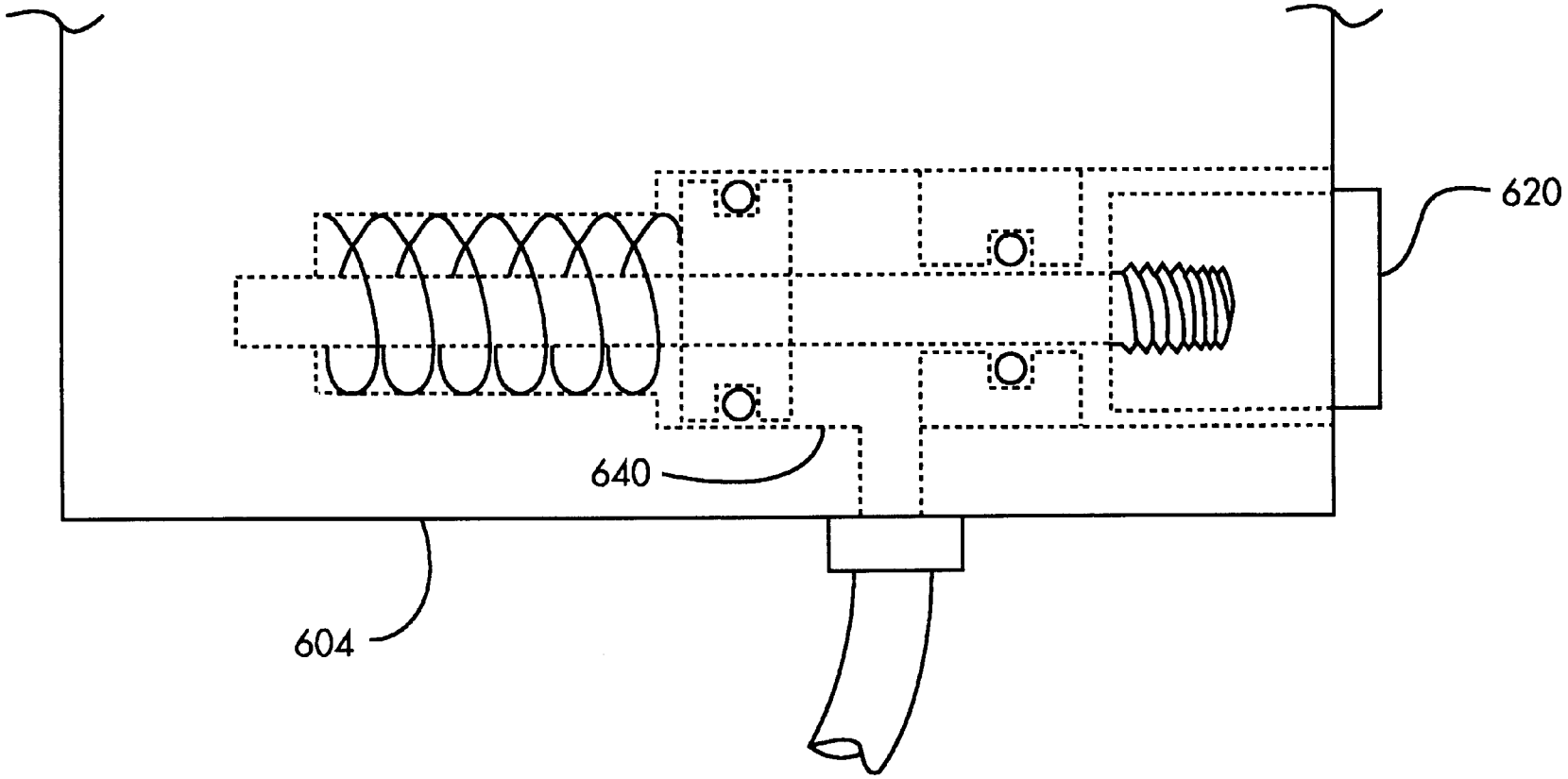

Pneumatic control system 600 in FIGS. 6E and 6F comprises a lifting air cylinder 602 attached to a header 604. Air cylinder 602 contains piston 606 and is connected to nylon-coated steel cable 610 which passes over idler pulleys 612, 614 and into grove 616 in bearing 130, where it is secured by clamp 618. Also shown comprising system 600 are pneumatic/spring latch bolt 620 (FIG. 6G), latch plate 622 and solenoid valve 625. An electro-pneumatic circuit diagram is given in FIG. 7B.

Automatic operation of pneumatic control system is, briefly, as follows. Loom 20 stops, opening "Loom Run" switch 624 contacts in loom electronics 155, thus de-energizing solenoid valve 625 and thereby connecting compressed air (about 100 pounds/in$^2$) to port B and connecting port A to atmospheric exhaust. Lift cylinder 602 and piston 606 are pressurized from solenoid valve 625 port B through rate-controlling orifice 626 which in turn pulls cable 610 over idlers 612, 614 and applies force to bearing 130 via clamp 618. Bearing 130 rotates about 90°, clockwise in this example, until piston 606 reaches the top of cylinder 602. Simultaneously, latch bolt 620 is driven out by an internal spring where it can engage latch plate 622; this combination enables a fail-safe mode to hold collector 120 up in case compressed air is removed.

When the loom runs again, and contacts 624 are closed, and also closed are all other series switch contacts (MECA volumetric air flow switch 628, AUTO/UP switch 630, compressed air switch 632), solenoid valve 625 is energized. Collector 12D rotates by gravity and, in this example, counter-clockwise, as air discharges via rate-controlling orifice 626 to solenoid valve 625 port B and finally, via the exhaust port to atmosphere. Simultaneously, latch bolt 620 is pulled into header block 604 by latch bolt cylinder 640, as seen in FIG. 6F, since it is now pressurized via solenoid valve 625 port A.

Figure 7B:
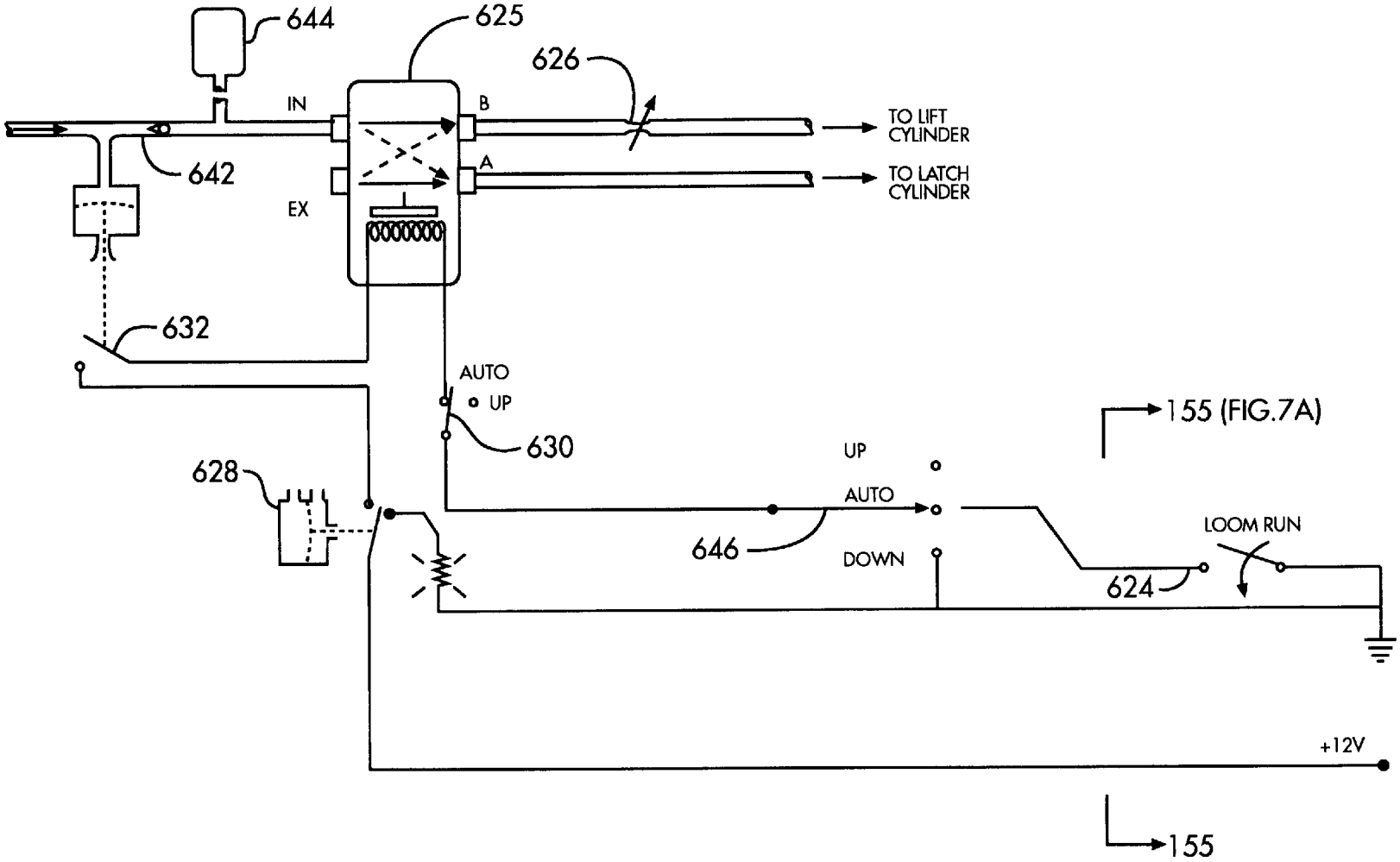
FIG. 7B is an electro-pneumatic schematic diagram for a pneumatic control system.

Note, for other fail-safe modes, that loss of +12V power or compressed air drives the collector 120-Operate to 120-Retract. Check valve 642 and reservoir 644 in FIG. 7B provide the pneumatic energy for the latter fail-safe mode.

Hand operation for the microcontroller-based system was explained above. Pneumatic hand operation here is effected with switch 646 (FIG. 7B) and the effects of the three contact positions of switch 646 are clear. Switch 646 is located in enclosure 647 and is connected internally to electro-pneumatic system via cable(s) 648 and externally to the weaving machine electronics or other electronics via cable (s) 649.

C3. Dedicated Blow-Off Cleaning (MECA-2)

Note again the high flow (approximately 2000 CFM), low static pressure (approximately 2 inches water column) blower wheel 147, described above for MECA-1 and shown in FIGS. 3A and 6A. MECA-2 described in FIGS. 3B and 6C combines blower 147 with a low flow (approximately 300 CFM), high static pressure (8 inches WC) blower wheel 148 mounted on the common shaft 202 extended from motor 146 and driven thereby. Blower wheel 148 preferably has forward curved blades 204 (FIG. 6D) and a larger diameter than blower 147, which preferably has backward inclined blades. The different flow and static pressure capabilities required lead to the different blower blade configurations and sizes.

Blower 147 delivers its high flow, low static pressure air flow components 181, 182 in FIG. 6C more fully around the periphery of general diffuser 180 than in FIG. 6A since directed source-capture air 123 (FIG. 5A) and the elements which enable this air 123, namely, directed diffuser 194 and conduit 190, are omitted. These air flow components 181, 182 in FIG. 6C produce a more or less conical air flow pattern, which is caused by internal vanes 185 and baffles 186. Those air flow components 181, 182 move back toward capture surface 110, as seen in FIGS. 4A and 5A, where they mix with room air components 121 and 122 upon entering collector 120.

Blower 148 derives its inlet flow 208 from holes 206 in the back plate 210 of blower wheel 147 and delivers its low flow, high pressure outlet flow 211, 212 into conduits 191, 192 (FIG. 6D). Also shown in FIG. 6D are usual flow strippers 213, 214 for forward curved blowers which facilitate pressure recovery in conduits 191, 192. FIG. 6D shows dual deliveries into conduits 191, 192 but one or three or four or more may be used.

To summarize, this second embodiment, MECA-2, consists of air and collector drive unit 140 (FIG. 6C), having dual delivery (via conduits 191, 192) low flow, high pressure blower 148 (FIGS. 6C, 6D), in combination with directed distributors 230, 232 and general diffuser 180, shown in FIG. 3B. MECA-2 supplies source air flow components 181, 182 from high flow, low pressure blower 147 in the more or less conical pattern described above. The directed source diffuser 194 (FIG. 3A) associated with MECA-1 is omitted.

Referring to FIGS. 3B, 6C and 6D which show the important internal arrangements of elements, we now explain how continuous blow-off cleaning is realized. Conduits 191, 192 deliver low flow, high pressure air flow components 211, 212 (FIG. 6D) to blow-off distributors 230, 232 FIG. 3B which are seen to apply high velocity blow-off jets 234, 236 to the drop wires in stop-motion assembly 58 or to the reed 56. Dust and fibers are thereby blown off and carried upward by capture air flow components 181, 182, 121, 122, and transported, along with other emissions 46–49, to capture surface 110.

Blow-off jets 234, 236 are elongated slots in conduits 230, 232 which are preferably 6 inches in diameter and extend fully under shed 28, 29 and cloth 25 for a length of, typically, 66 inches. Conduits 230, 232 can oscillate rotatably around their axes, thus sweeping blow-off jets 234, 236 over the machine components being cleaned, namely, reed 56 and drop wires 58.

Blow-off jets 234, 236 continuously operate and furthermore operate continuously across the weaving machine in this MECA-2 embodiment. They are thus dedicated 100% to these important cleaning functions.

In some weaving applications, it is necessary to have blow-off jets having higher localized velocities (i.e., driven by higher static pressure) than can be achieved with a single stage forward curved blower 148. In those cases, well-known multiple stage blowers can be used or a separate, single stage blower operating at higher speed can be used. However, since blower power requirements increase as the product of flow rate and total pressure, and since in some cases periodic blow-off is acceptable, FIG. 3C shows a scanning blow-off distributor 240 which enables localized, higher intensity blow-off jets 232, 234.

Holes 242 are provided in a serpentine or barber-pole pattern around and along internal cylinder 244 which is supported and rotated by motor 246. Bearing 243 supports the left end of cylinder 244. Low flow, high pressure air 212 is delivered, via conduit 192, from blower 148 (FIGS. 6C and 6D) or from alternate means having higher pressure. Preferably, the outside diameter of blow-off distributor 240 is 4 inches, holes 242 are 0.75 inch diameter and drilled on 1.0 inch centers. Motor 246 rotates internal serpentine cylinder 244 at about 30 RPM, thus scanning the blow-off jet 250 across a slot 241 in length of the distributor 240 once in 2 seconds. The length is set by the cloth 25 being woven in loom 20 (FIG. 2) but is typically 66 inches.

Referring again to FIG. 3B, blow-off flow 234 is directed toward reed 56. To preclude interference with insertion of filling yarn 23, the scanning, high velocity flow 234 enabled by scanning blow-off distributor 240 (FIG. 3C) is modified. Distributor 240 operates in synchronism with reed 56 motion so that flow is stopped when reed 56 is back and filling yarn 23 is being inserted. One simple change is to synchronize cylinder 244 rotation with beater position so that there is no hole 242 in slot 241 during filling insertion.

FIG. 3A discloses provision of dedicated "blow-up" distributor 194 and FIG. 3B discloses provision of "blow-off" nozzles 230, 232. Air flow for both is sourced from blower wheel 147 in FIG. 6C or, if higher velocity cleaning is needed, from additional blower wheel 148. "Blow-up" distributor 194 air flow 123 parameters may, for this discussion, be partially described by volumetric flow rate=2000 $FT^3$/MIN, velocity=1000 FT/MIN, and further correspond to 50% of the air flow delivered from fan 147. Not described are temperature, humidity, or other gas flow parameters, any one or all of which such environmental parameters can be controlled by our invention.

Air flow parameters delivered form blower 148 to either blow-off pipe 230, 232 may be descried as 200 $FT^3$/MIN and 10,000 FT/MIN. Higher values of either volumetric flow rate or flow velocity are, of course, provided by our invention and are used when the extra costs are justified. Similar provisions and justifications apply to the extra complexity of oscillating, pulsing, scanning, or synchronizing the dedicated air flow components, as described above.

For air flow cleaning, effectiveness is largely a matter of gas velocity of the air "jet" at or near the surface to be cleaned. The power required rapidly increases with cleaning velocity and area to be cleaned. Our invention further includes an interesting and useful limiting case wherein compressed air is applied to very small areas and sometimes for very short pulses. The cleaned material is "fluidized" and preferably captured by one or more MECA capture elements. At standard temperature (72° F.), compressed air nozzle velocities approach sonic speed (Mach 1) of about 1100 FT/SEC=66,000 FT/MIN. Volumetric flow rates, for the embodiment(s) below are of order 0.1 $FT^3$/MIN; the nozzles operate, typically, with less than 10% duty cycle.

Figure 6H:
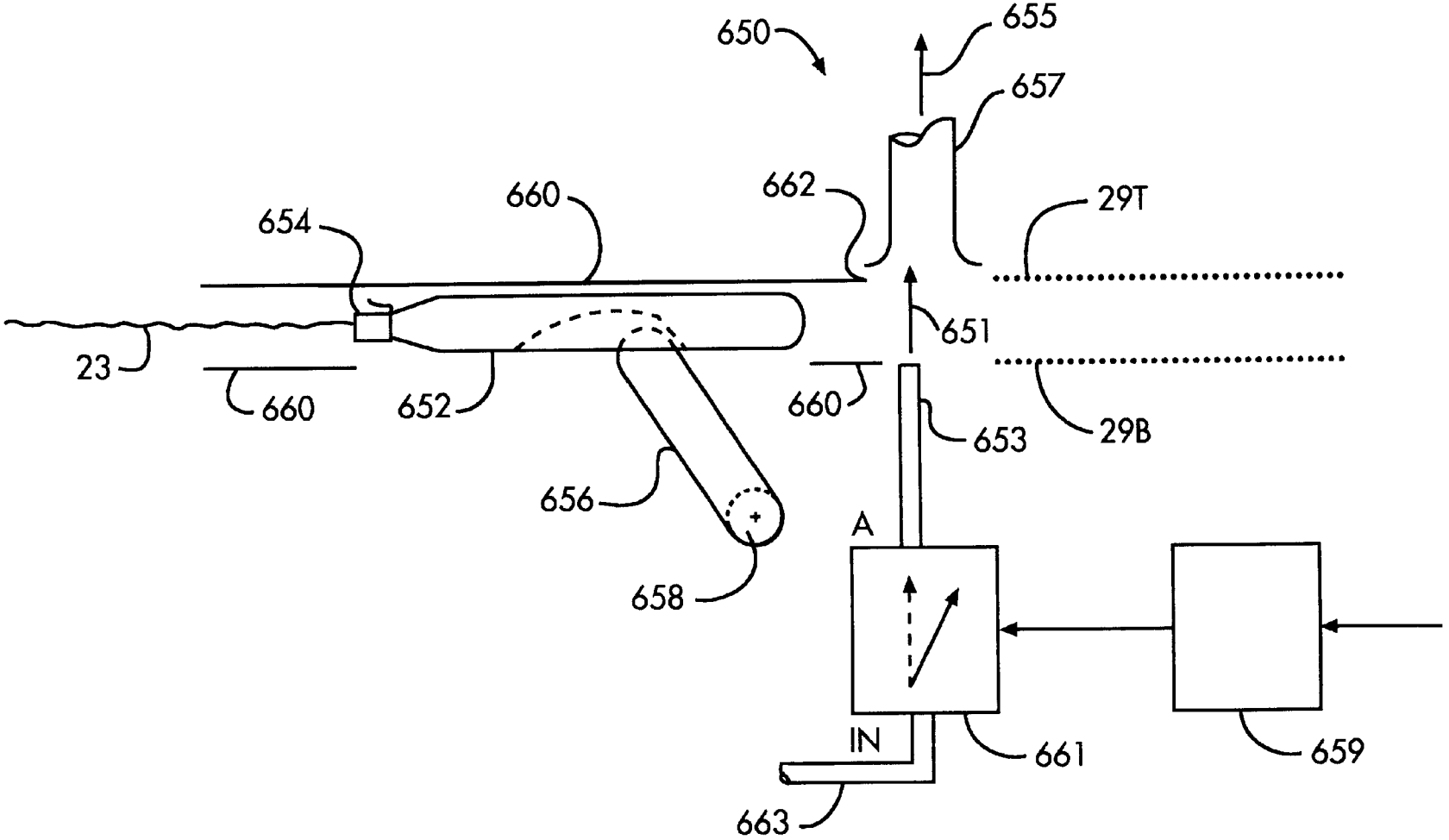
Figure 61:
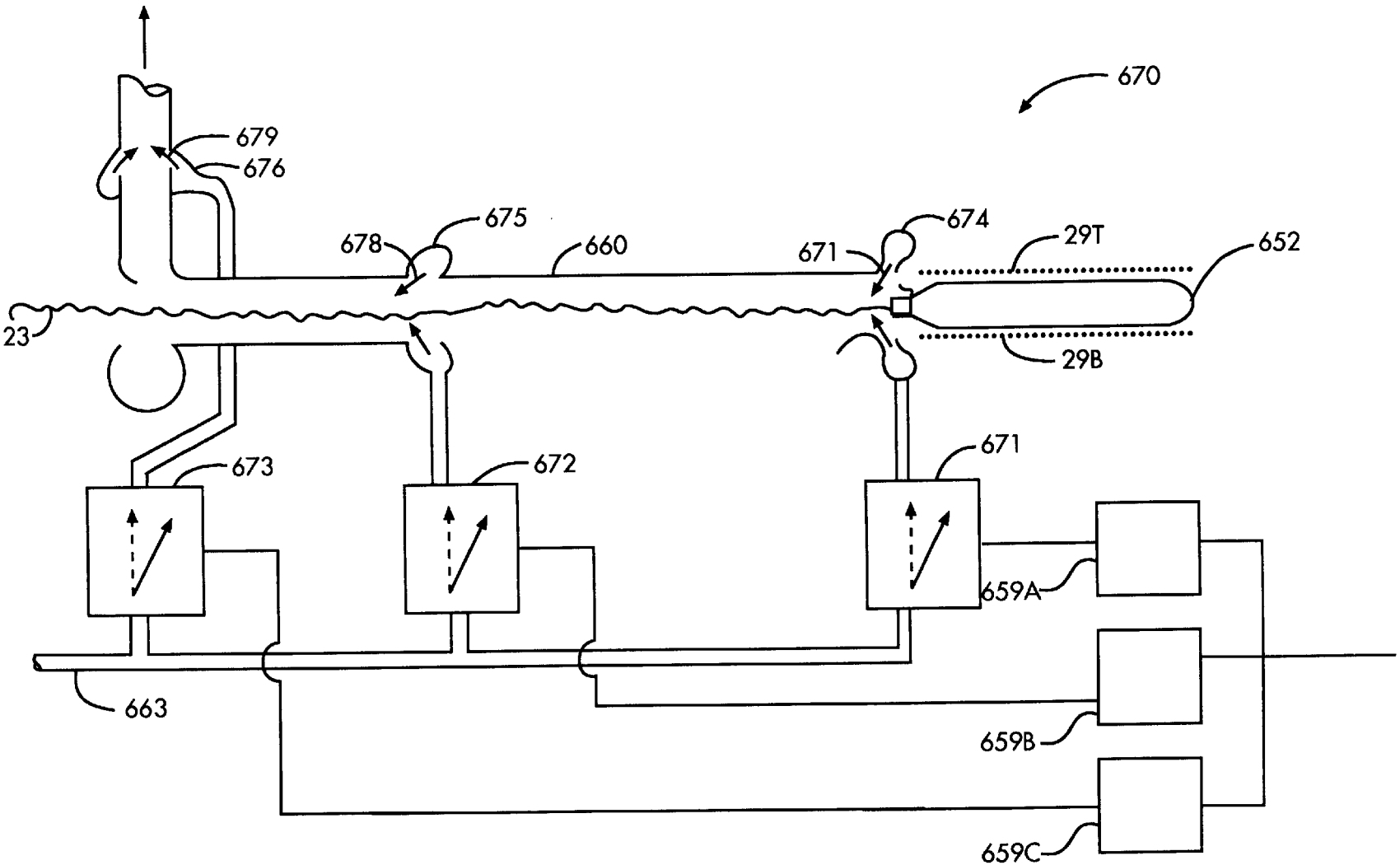

FIG. 6H discloses a "cross flow", compressed air jet cleaning apparatus 650. This very high intensity, low volumetric flow rate apparatus is preferably applied to so-called projectile looms, now briefly described, but it and other configurations can be applied to air jet looms 20, described above, or to other fabric formation systems, especially including knitting machines.

Projectile looms insert filling yarn 23 by means of projectile 652 which is launched or "shot" through open front shed 29T, 29B by lever arm 656. Energy stored in torsion bar 658 is released into kinetic energy of projectile 652. After the filling 23 is inserted into shed 29T, 29B, the shed closes and reed 56 packs the filling yarn into cloth 25, exactly in function as for air jet or any other weaving machine.

The next projectile 652 is inserted into guide 660, typically from below, filling yarn 23 is placed in gripper 654, and the process is repeated.

Projectile 652 fits tightly and precisely within guide 660 and lubrication is essential. When filling yarn 23 is spun yarn, and especially if it is cotton or fragile fiber, fiber fragments and dust are released by the vigorous and frequent filling insertion actions. Dust and fiber fragment and oil accumulations form at various places, such as at the trailing end 662 of guide 660. These accumulations build up, randomly release, and some of them are carried into the shed 29T, 29B and woven into the fabric, forming imperfections known as "slubs." The accumulations can also release onto the fabric 25 or into the loom 20 machine parts.

Cross flow air jet cleaning apparatus 650 eliminates this accumulation problem by application of intense but short (10 millisecond) pulses of clean compressed air 651 via nozzle 653 which is positioned within very close proximity to trailing end 662 of guide 660. Cleaned material is transported by flow 655 in conduit 657 to a MECA capture surface 110A. Air jet pulsed flow 651 is applied in synchronism with loom operation. Electrical signals from loom 20 are delivered to pulse control electronics 659 and fast-acting solenoid valve 661 is appropriately energized to deliver air jet pulse flow 651 at the correct time and for the desired duration. Clean compressed air is supplied via pipe 663 to solenoid valve 661.

Figure 6J:
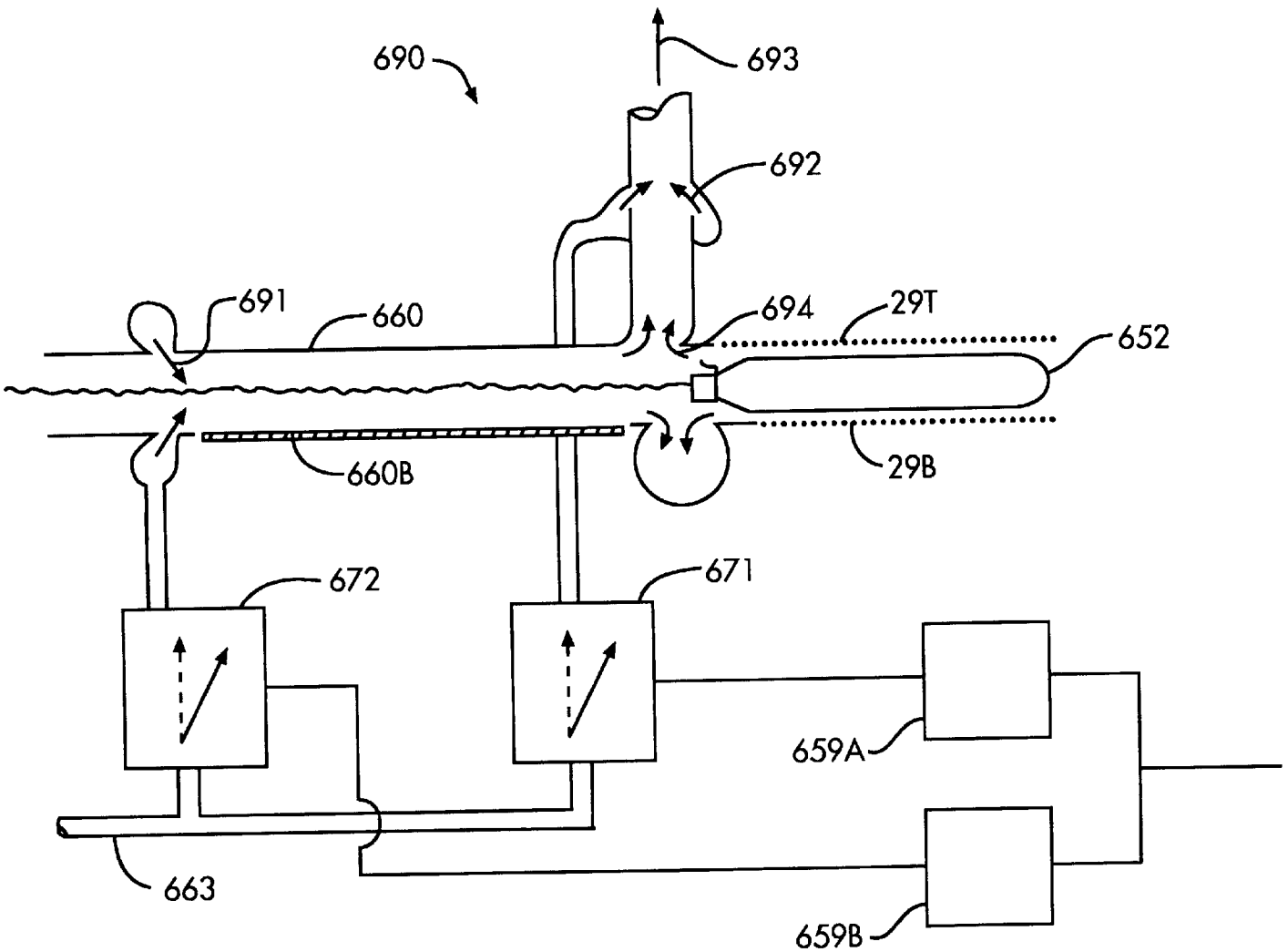

FIGS. 6I and 6J represent expanded embodiments to cross flow air jet cleaning apparatus 650 (FIG. 6H) and are, respectively, called counter-flow 670 (FIG. 6I) and parallel 690 flow (FIG. 6J) air jet cleaners.

In FIG. 6I, projectile 652 has just been launched into open shed 29T, 29B to insert filling yarn 23. Fast-acting solenoid valves 671, 672, 673 respond to synchronizing signals from pulse control electronics 659A, 659B, 659C and apply clean compressed air from pipe 663 to plenums 674, 675, 676. Intensely energetic, short duration, primary plus secondary air flow or jets 677, 678, 679 result. (Primary air flows from plenums 674, 675, 676 are preferrably applied symmetrically around the approximately circular cross sections of guide 660 and eductor tubes 680, 681 and induce about 5 times as much secondary air flow.) These intense, pulsed air jet cleaning flows 677, 678, 679 not only remove dust plus fiber fragments plus oil accumulations, they strip dust and fiber fragments from filling yarn 23 while it is being inserted in open shed 29T, 29B and carry these contaminants to a MECA capture surface 110A or to some similar capture apparatus. Still further, since pulsed air jet flows 677, 678 are in direction counter to the yarn 23 movement (hence the name aerodynamic drag) tensions yarn 23. This counter flow air jet 670 tensioning can elimate or simplify mechanical tensioning devices (frictional brakes) which cause dust and fiber fragment release.

FIG. 6J shows a parallel flow pulsed air jet cleaner/assistor 690. Synchronized excitation of solenoid valves 671, 672 is the same but in this design, the bottom of guide 660 is closed with section 660B and the air jets 691, 692 cause flow 691 in guide 660 to be parallel to or to assist the motion of yarn 23 in addition to providing cleaning. Combined flow 693 transports cleaned materials to MECA capture element 110 or the like. Transport flow is the combination of parallel flow 691 and counter flow 694.

It is, of course, preferable in some cases to combine cross flow 650, counterflow 670, and parallel flow 690 cleaners and to fully exploit the aerodynamic drag on filling yarn 23 for braking or assisting purposes.

C4: High Local Exchange Rates and Tightly-Coupled Process Zones (MECA-3)

Loom/Room

It was noted above that major distinguishing features of our invention are the proximity and positionability of source and capture elements to the process zone. It follows that the volumes associated with each process zone or sub-zone are much smaller than prior art devices. Since volumetric exchange rate calculations are well known in the art of central environmental control, we now briefly develop this concept to the end of more fully explaining some of the novel features of our invention which dramatically distinguish it from prior art.

Consider first a loom 20 situated in a processing room environment 112. Associate with the loom 20 a floor area of 16 feet by 16 feet=256 $FT^2$ and a ceiling height of 18 feet. This is clearly a per loom expression of this totality of looms 20 situated in the entire processing environment 112. If a central air conditioning system supplies and returns 2000 CFM to the volume associated with this one loom 20, 256 $FT^2 \times 18\ FT^3 = 4{,}608\ FT^3$, the volumetric exchange rate E is $$E = 60\frac{Q}{V} = 60 \times \frac{2000}{16 \times 16 \times 18} = 26 \text{ changes/hr.} \quad (1)$$

This rate is representative of current practice, as noted above.

MECA-1

Next consider the MECA-1 embodiment in FIGS. 1, 2 and 3A. By design, much of the air flow captured by collector 120 is sourced, in close proximity, from general diffuser 180 and directed diffuser 194. Assume 50% recirculation and total MECA flow=2000 CFM. This means that 50% of the captured air flow components 121, 122, 123, 181, 182 originates with the room environment 112 air flow components 121, 123. Alternatively, air flows 121, 122 are numerically equal to air flows 123, 181, 182. Assume further that close proximity means that the 50% recirculated is confined to an effective volume defined by the loom width and depth, both about 8 feet, and assume an effective height of 6 feet. This gives $$E = 60 \times \frac{2000 \times 0.5}{8 \times 8 \times 6} = 156 \text{ changes/hr.} \quad (2)$$

The interpretation of this result is simple and significant: proximity enhances exchange rate. This means that emissions are far more effectively captured. Also, the effective volume is much more quickly changed or, alternatively stated, the response time is much shorter.

There are "down-sides": proximity can mean interference with weaving operations; quick response requires fast sensors and controls; and recirculation can lead to different equilibrium levels for environmental parameters (dust and heat build-up, moisture loss, etc). Those "down-side" problems are readily solved in the methods and apparatus described herein.

MECA-3

Noting the up-side or positive results associated with higher exchange rate, and recognizing the down-side solutions disclosed later, it is most informative to compute a limiting exchange rate for MECA-3 described in FIG. 8A. The volume within the insulated (thermally and acoustically) process zone envelope 260 is roughly 6 FT (cloth 25 width) by 4 FT (front to back depth)×2 FT (effective height)=48 $FT^3$ and, for Q=2000 CFM, $$E = 60 \times \frac{2000}{48} = 2500 \text{ changes/hr.} \quad (3)$$

Evidently, proximity indeed enhances exchange rate.

It is also informative to calculate the minimum clearing or change time for this tightly-coupled embodiment:

$$T = \frac{V}{Q} = \frac{48}{2000} = 0.024 \text{ min} = 1.4 \text{ sec.} \quad (4)$$

This result represents a characteristic time for the flow Q to exchange or "clear out" volume V of the process zone 60 volume within envelope 260. This is the minimum time in which changes to environmental parameters (dust concentration, temperature, humidity, etc.) in process zone 60 can be made.

Figure 8A:
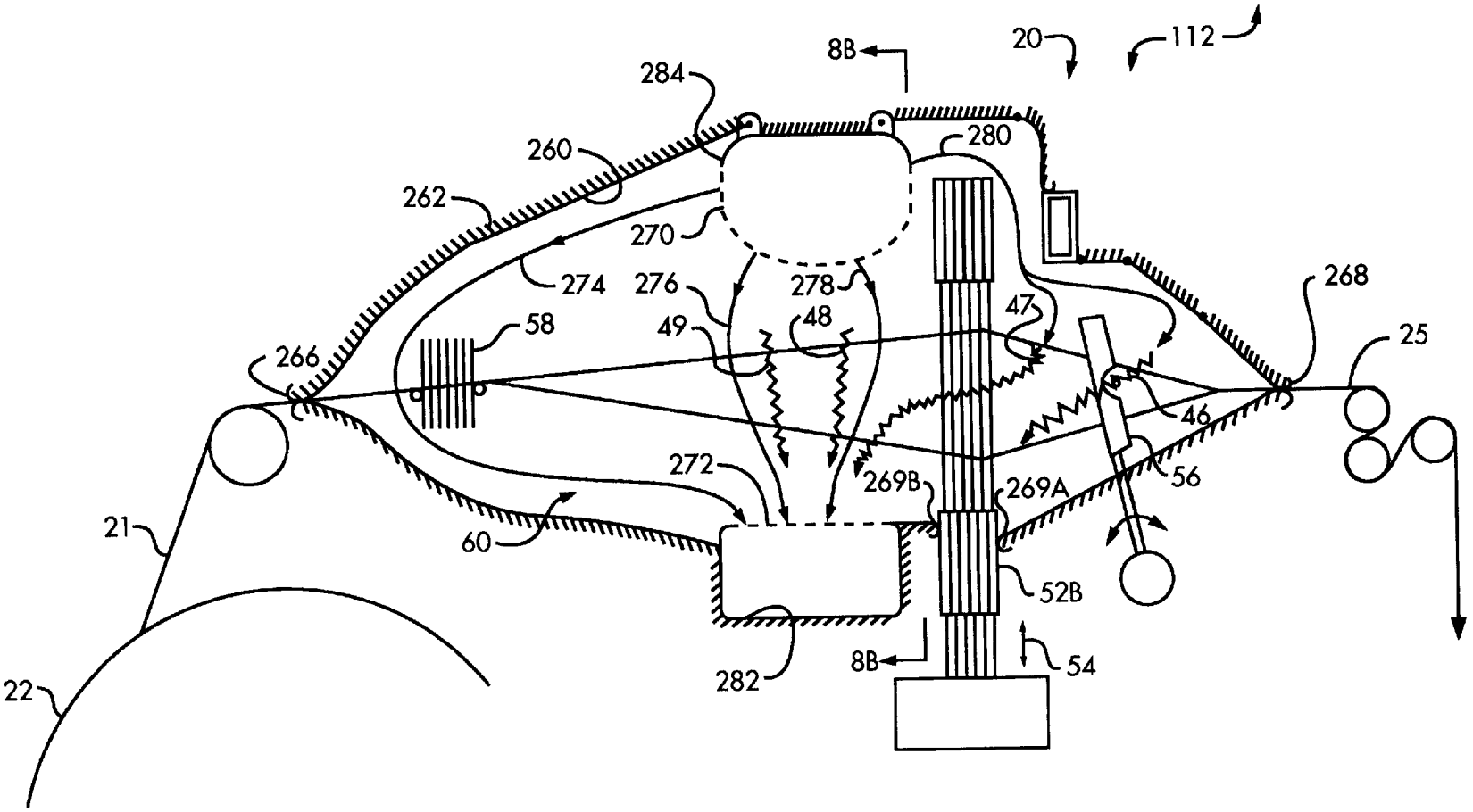
FIGS. 8A and 8B depict downward flow from a directed source diffuser.

Process zone enclosure 260 in FIG. 8A represents a limiting concept wherein the process zone 60 is isolated by thermal and acoustic insulation 262. The materials to be processed, warp 21 and filling 23 yarns, are introduced into the process zone through seals 266, for the warp yarn 21, and similar but unshown seals for the filling yarn 23. Cloth 25 is delivered from envelope 260 via seal 268. Seals 269A, 269B operate against bottom harness frame 52B. Additional seals are, of course, required and their designs are well known. In some cases it is also necessary to enclose filling yarn packages 24 and accumulators 26 (FIG. 2).

Whereas the process zone 260 volumetric calculated above was seen to be very high, E=2500 changes/hour, which is about 100 times higher than prior art central air conditioning systems, and the cleaning time T=1.4 seconds is very short, these parameters only partially explain the benefits of our invention. Further major advantages of "tightly-coupled", modular process zone environmental control over prior art include:

1. Possibilities to process materials in process zone environments totally different from or incompatible with personnel zone environments. To dramatize: when economically justified, weaving can be performed at extremes of temperature or gas composition, at 300° F.

or in a noble gas for examples. In some cases, different process zone environments facilitate the justifications. Weaving at 150° F. in an insulated process zone can lead to dramatic savings in air conditioning costs.

2. Control of the processing machines on a machine-by-machine basis.
3. Rapid control response.
4. Almost complete capture of emissions (including noise!) and separation or isolation of process zones and personnel zones.

It is now clearer that "tightly-coupled" means more than a closely proximate, small, tightly-sealed process zone 60 within envelope 260; it means that the process zone 60 environmental parameters are almost completely controlled by, or are "tightly-coupled" to, the modular environmental control apparatus. Tightly-coupled also means, machine-by-machine, gross profit optimization.

Figure 8B:
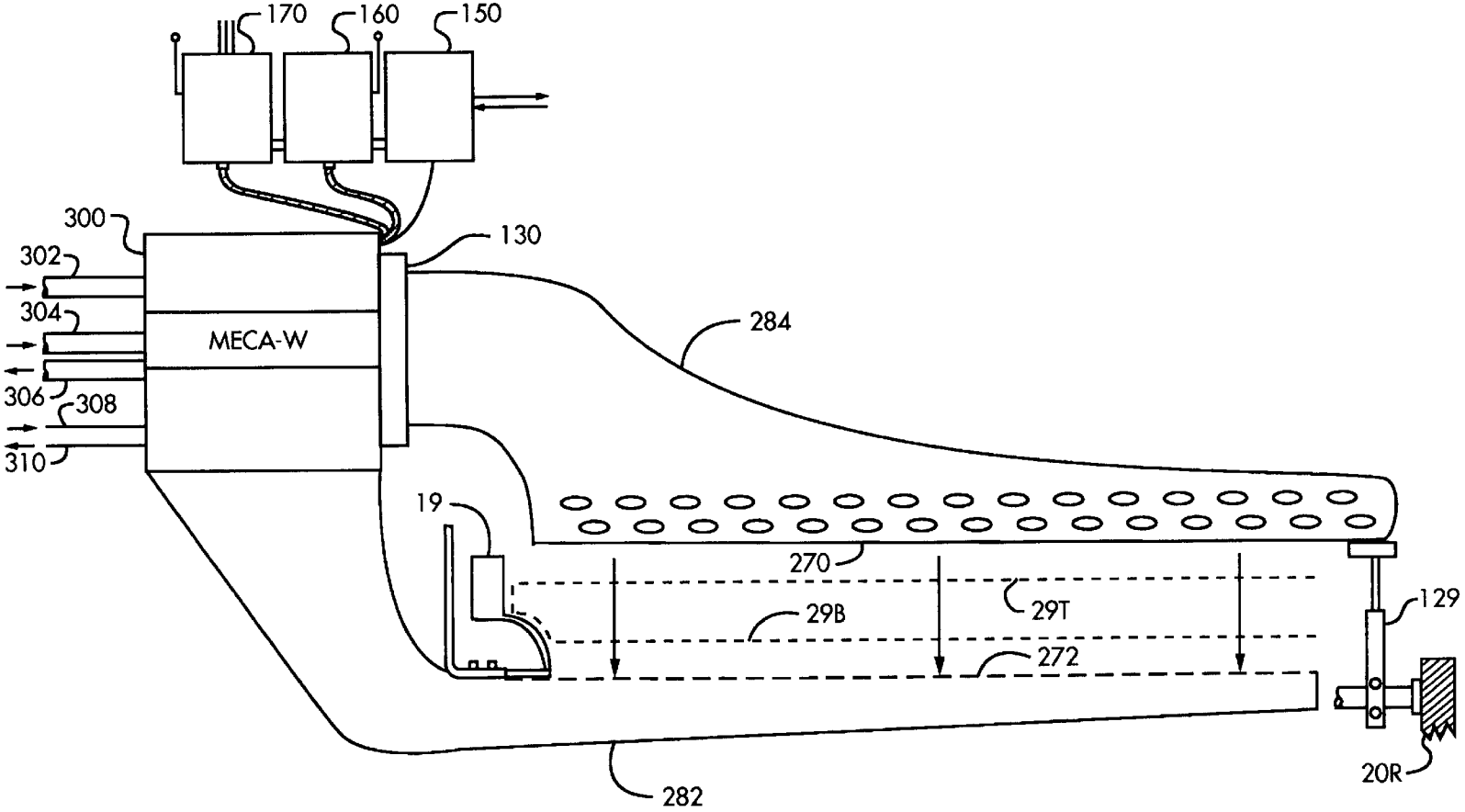

FIGS. 8A and 8B show, for MECA-3, downward flow 276, 278 from directed source diffuser 270 to capture surface 272. This is in contrast to upward flow for MECA-1. Downward flow components 274, 276, 278, 280 carry emissions 46–49 into capture surface 272. Dust is not collected on capture surface 272 but is transported by collector-conduit 282 to filtration means in air drive unit 300 such as is taught in FIG. 12 of Shofner U.S. Pat. No. 4,881,957

Collector-conduit 282 is stationary because it is less practical to move it out for cleaning than to perform the filtration externally in air drive unit 300. Source diffuser 270 and its air supply conduit 284 must be retractable and, of course, process zone envelope 260 must also automatically retract. Conduit 284 is rotatably retracted by rotary joint 130, exactly as collector 120 was retracted as described in FIGS. 5A and 5B. The retraction of the top of envelope 260 follows the design of MECA-4, described below.

FIG. 8B shows a pure water conduit 302 feeding into drive unit 300 for humidification of the process zone environment. A humidity sensor within said environment impresses a signal onto one of microcontroller 200 inputs 400 (FIG. 7) and the amount of moisture delivered to the environment is controlled by one of microcontroller 200 outputs 500. Conduits 304, 306 deliver cooling fluid to drive unit 300. Heat is exchanged via well-known coils and the cooling fluid parameters are sensed and controlled by microcontroller 200 inputs 400 and outputs 500. Electrical conductors 308, 310 similarly enable control of ion content, under microcontroller 200 control. All of these, and other environmental parameters within process zone 60 are supplied, sensed, and controlled by well-known means.

Similar environmental controls 302, 304, 306, 309, 310 are shown servicing drive unit 140 in FIG. 4A.

MECA-4

Figure 9A:
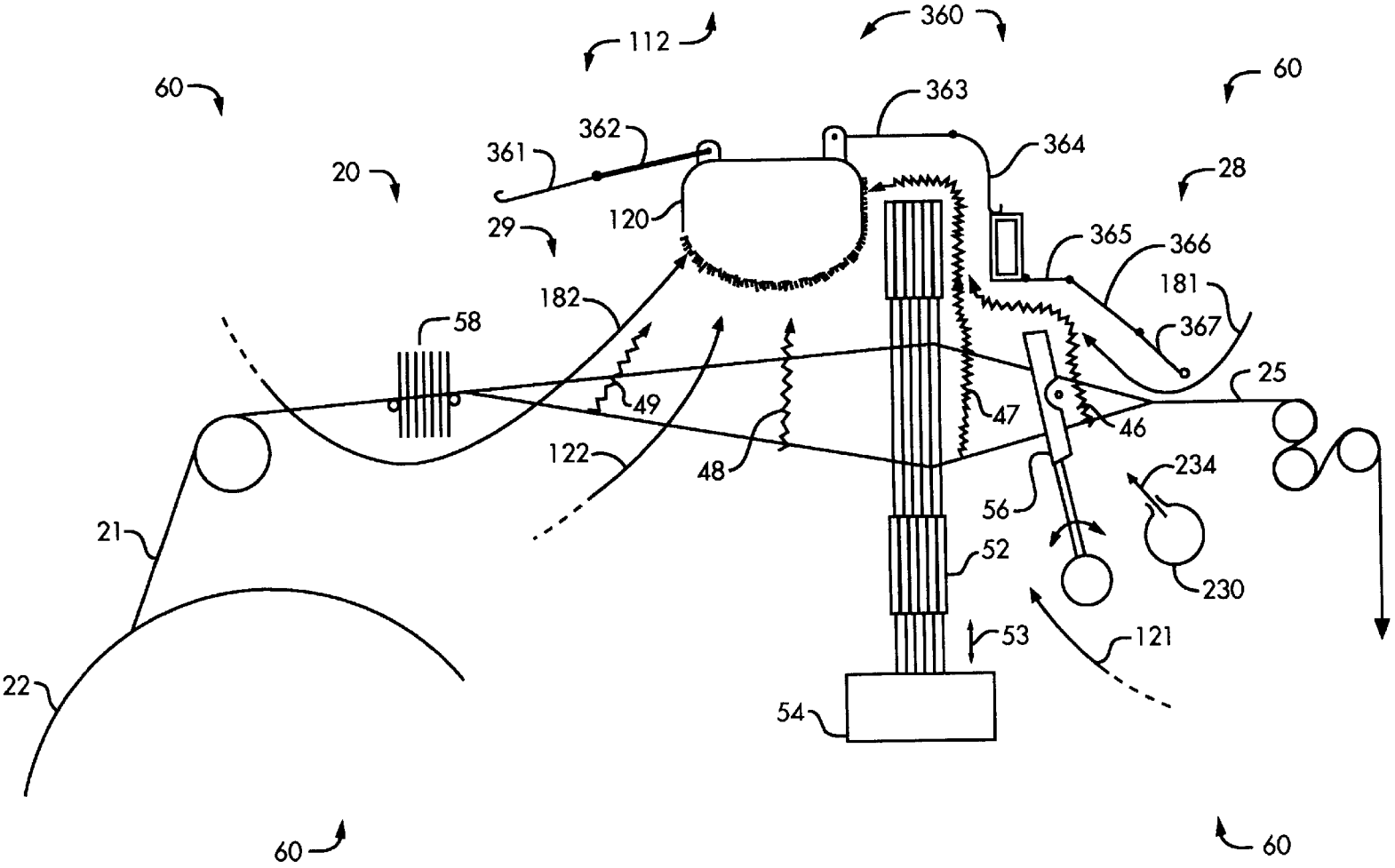
FIGS. 9A and 9B depict several conditions of a foldable envelope.

Whereas MECA-3 represents a limiting yet novel concept for proximity or tight coupling, the embodiment of FIG. 9A represents a practical compromise which is particularly effective for retrofit installations. Much of the detail in FIG. 9A is seen hereinabove in FIGS. 3A and 3B in the MECA-1 and MECA-2 embodiments. The elements included in FIG. 9A have the same meanings and functions. The directed diffuser 194, seen under shed 29 in FIG. 3A, is excluded, and one dedicated blow off air 234 distributor 230, as first seen in FIG. 3B, is added. Humidification water via conduit 302 (FIG. 4A), cooling fluid via conduit 304, 306, and electrical power via conductors 308, 310 would be used as necessary and justified.

To complete the major elements for MECA-4, partial envelope 360 is added and comprises three sets of hinged covers 361, 362; 363, 364; and 365, 366, 367. When envelope 360 is closed, as in FIG. 9A, preferred patterns in capture air flows 121, 122, 181, 182 and including continuous blow-off jet 234 are established. Covers 361, 362 cause air from the MECA-4 general diffuser, components 181, 182 and from the room environment 112, namely 121, 122, to mix and flow down into and then up through the warp yarn 21 in back shed 29. This results in significantly improved environmental parameters in back shed 29 (reduced temperature, elevated humidity, and lower dust and fly concentration and deposition).

Covers 363, 364 and 365, 366, 367 confine and constrain the vigorous fanning action of reed 56 and provide a flow path for emissions 46, 47 to reach collector 120. Release and transport of emissions 46, 47 are aided by continuous blow-off air jet 234.

Note that cover plate 367 does not contact or seal against cloth 25, but rather allows air flow component 181 to enter. Note also that continuous blow-off air jet 234 may be highly humidified to enhance warp 21 yarn strength and elasticity, i.e., to "toughen" the yarn in front shed 28.

Figure 9B:
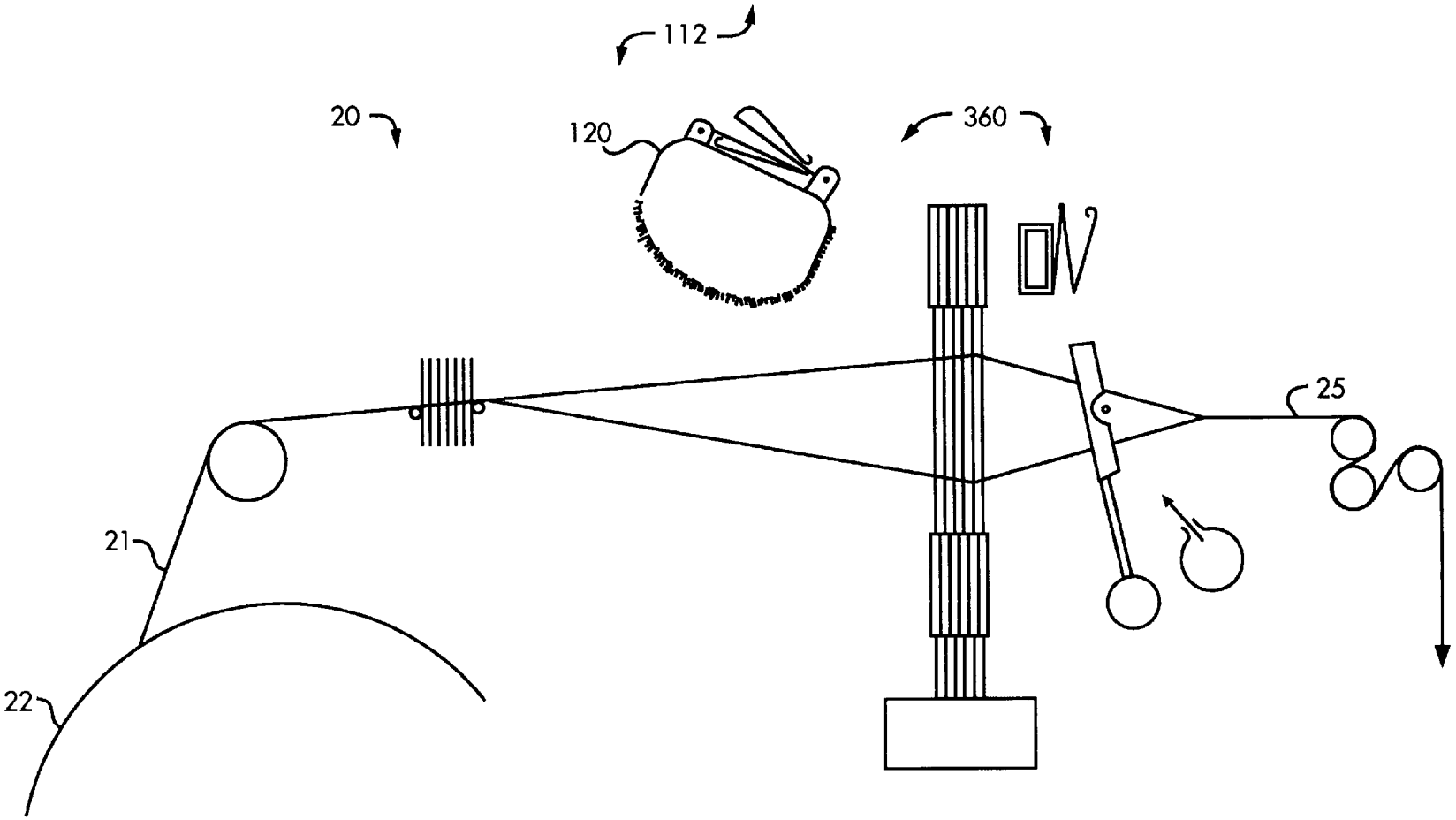

FIG. 9B shows partial envelope 360 folded into RETRACT mode and collector 120 moved partially toward RETRACT position 120-R. (The individual segments 361–367 are shown slightly opened or separated for clarity.) The elements in FIG. 9B are the same as in FIG. 9A. Only essential reference numbered elements are retained in order to show how completely partial envelope 360 is retracted.

C5: Exemplary Results

Two secret trials have yielded the following performance results with air jet looms operating at 600 picks/min.

1. Denim, MECA-4 (without blow-off jets)
   - A. Weaving Performance
     Not Yet Evaluated
   - B. Process Zone Thermal Changes
     (MECA ON-MECA OFF) −1.7° F., +5.5% RH
   - C. Air Contaminants
     Respirable Dust
     Personnel Zone 1500→350 $\mu g/m^3$
     Process Zone 3000→500 $\mu g/m^3$
     Total Dust Captured 1 pound/12 hours
2. Twill, MECA-1
   - A. Weaving Performance
     Filling stops reduced from 4 to 2 per 100,000 picks.
   - B. Process Zone Thermal Changes
     (MECA ON-MECA OFF) −1.5° F., +5% RH (without humidification) +2° F., +10% RH (with steam humidification)
   - C. Air Contaminants
     Lint deposition flux reduced 50%.

D. Modular Personnel Zone Environmental Control

Figure 10:
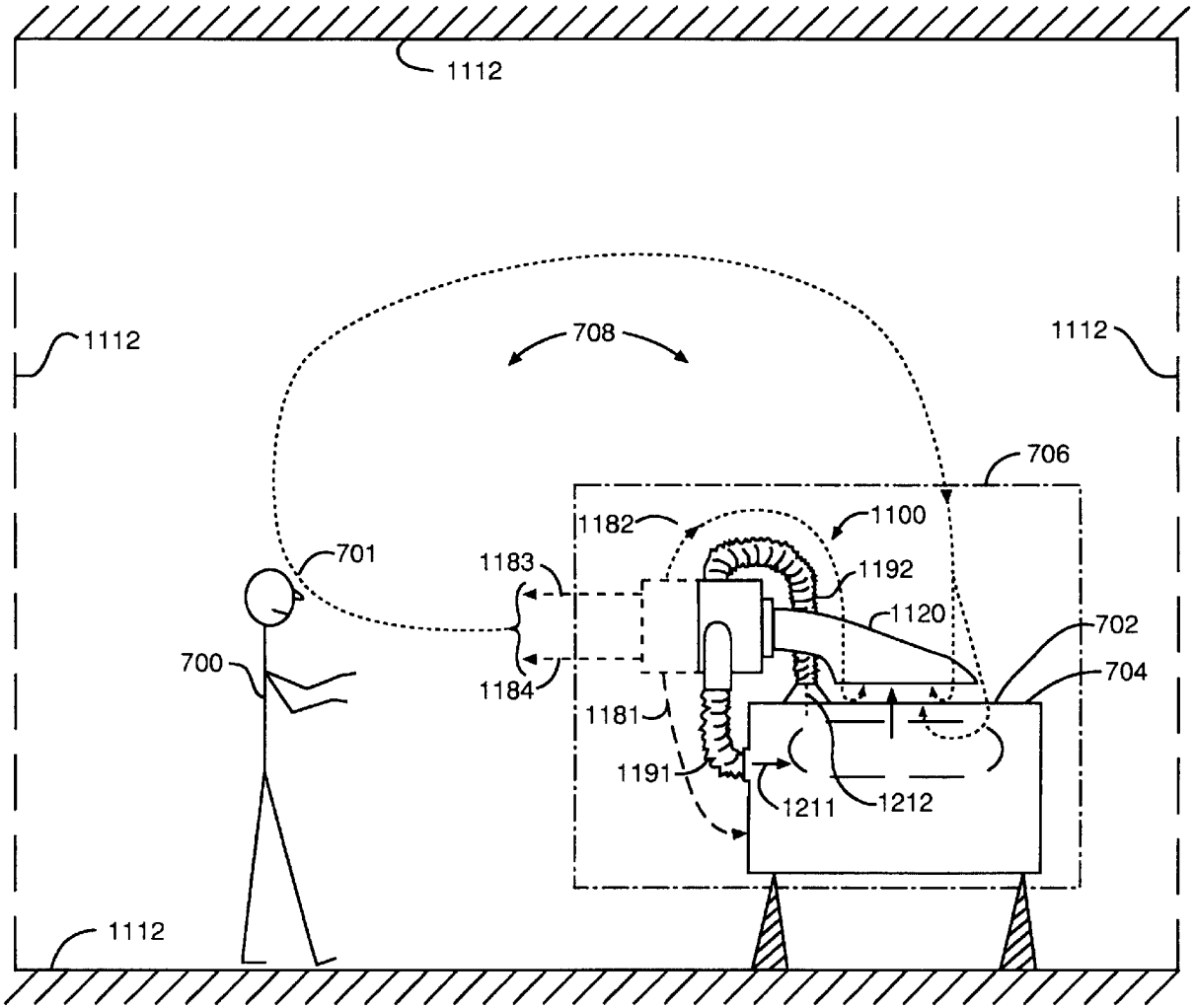
FIGS. 10, 11, 12 are partly elevational and mostly schematic descriptions of a materials processing machine and human worker in thermodynamic envelope in a production environment.

Personnel 700 are still needed to operate and maintain materials processing machinery 702, FIG. 10. Cohabitation of production environment 1112 is necessary but it is not essential, healthful, or optimally profitable for both humans 700 and machines 702 to "breathe" the same gas or be subjected to the same noise, radiant energy, air contaminants, etc.

FIG. 10 shows a thermodynamic envelope 706 which is situated within production environment 1112. Within envelope 706 is situated one process machine 702 and one environmental control apparatus 1100 according to the instant invention. Personnel zone 708 is thus defined as that region of production environment space 1112 which is not within thermodynamic envelope 706. Thermodynamic envelope 706 is simplistically drawn in FIG. 10 for heat load and other energy and mass transport considerations but can, more practically, be regarded as generally conforming to the outer surfaces of materials processing machine 702 and environmental control apparatus 1100. There will be mass and energy transport across envelope 706. Also, personnel 700 will infrequently and partially penetrate envelope 706, particularly for maintaining machine 702. Other academic comments could be made but, for our purposes here, it is sufficient to consider that personnel 700 work in the personnel zone 708, materials processing machine 702 works within thermodynamic envelope 706, and that said materials processing or work is principally performed in processing zone(s) 704 or in sub-zones thereof . Further, production environment 1112 is also regarded as a thermodynamic envelope across which energy and mass are transported, including materials into and out of production machine 702 and various utilities like electricity, compressed air and cooling fluids. Conditioned gas captured from or sourced to personnel zone 708 or process zone 704 does not cross envelope 1112.

Accordingly, our invention enables: (1) isolation or separation of personnel zone 708 and process zone 704 and (2) independent control of gas flow conditions into and out of personnel zone 708 and process zone 704. In an important special case, gas flow conditions in both personnel zone 708 and process zone 704 may be simultaneously controlled by a modular environmental control apparatus (MECA) 1100.

In Section C, "Modular Process Zone Environmental Control," capture 120 and source 194 elements, in combination with modular environmental control apparatus 100 were disclosed with emphasis on describing how contaminants (dust, fly, gases, etc) are captured and on how weaving process zone gas weaving flow conditions are controlled. Weaving, of course, is only one materials processing machine to which our method applies. Importantly, in part (not all) of that disclosure, gas flow source components were specified to return to the process zone or to the personnel zone. Reference is made to FIGS. 1A, 3A, 3B, 5A, 6A, and 6C and to gas flow source components 121, 122, 211, 212, 181, 182, 183, 184. Each of these gas flow sources is conditioned to have preferred values.

The gas flow components 1183, 1184 are "sourced to" personnel zone 708 (FIG. 10) and the emphasis of this Section D is to describe how preferred values for environmental parameters therein may be simultaneously, yet independently, be controlled by modular environmental control apparatus 1100.

(Note, in FIGS. 10 and beyond, for a generic materials processing machine 702, that call-out numbers beginning with 1000 have corresponding elements with generically similar functions in the earlier figures which describe a preferred embodiment of our invention, as applied to weaving. Modular environmental control apparatus in FIG. 10 is seen to derive several features from the corresponding device in FIG. 2. FIGS. 6A and 6C also reveal some detailed features seen in FIG. 10.)

Although the emphasis in this section is on personnel zone 708 and on sourcing air with desirable parameters thereto, it is most important to appreciate that personnel zone 708, or any sub-zones thereof, is equivalent to process zone 704 or any sub-zones thereof, in so far as the gas flow conditioning objectives of our invention are concerned. This more thorough disclosure for personnel zone 708 is in respect of humans 700 which work in it. The gas flow conditioning elements and control concepts of this more thorough disclosure, of course, apply to process zone(s) 704 in FIG. 10 or to process zone 60, for earlier figures.

Figure 11:
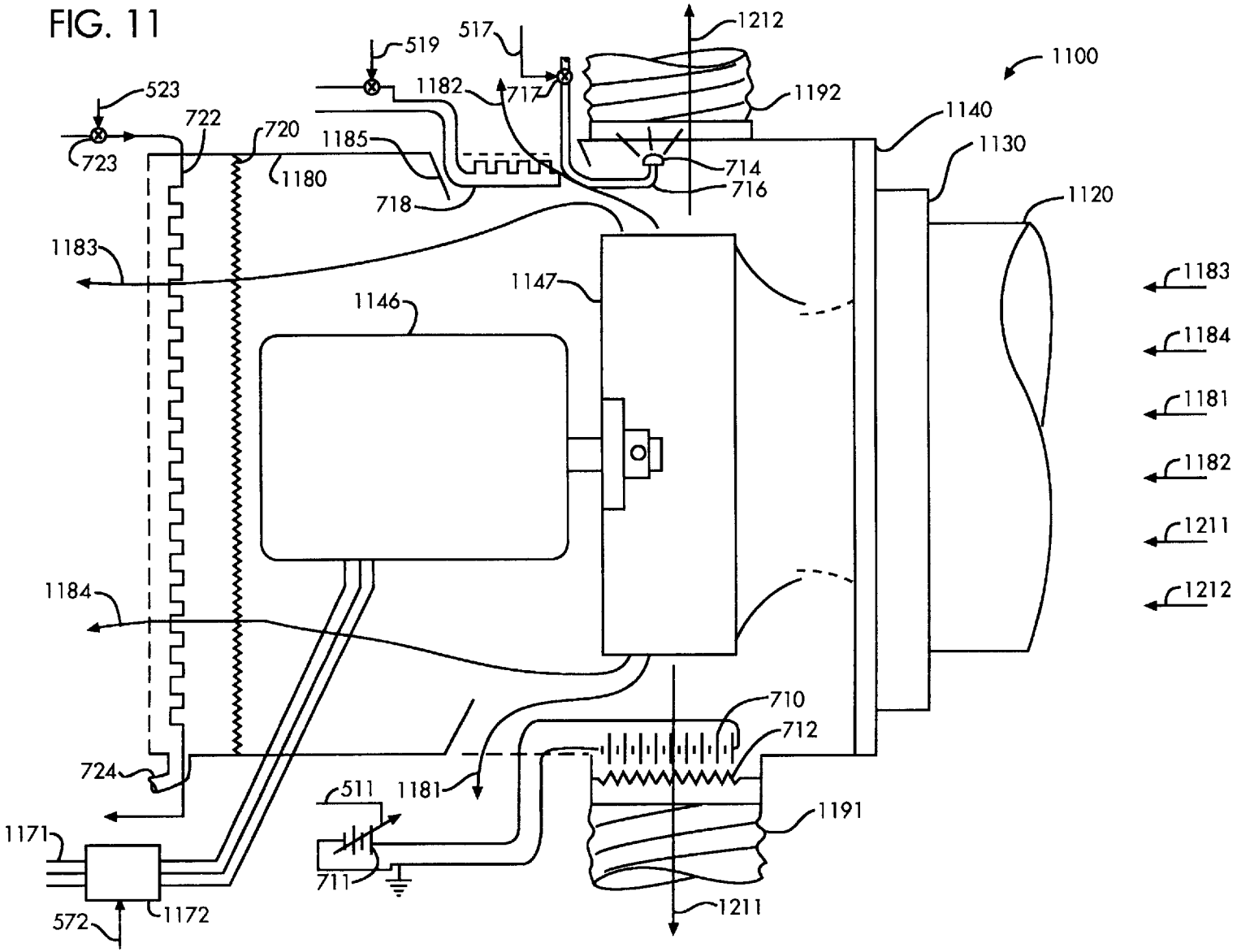

FIG. 11 is a partly elevation, partly cross-sectional, and partly schematic drawing of the air and collector drive unit 1140. Fan 1147 pulls in gas flow capture components 1183, 1184, 1181, 1182, 1211, 1212 and blows an identical gas mass flow (pounds mass per second)out. After internal flow division, source components 1183, 1184, 1181, 1182, 1211, 1212 are seen to leave diffuser 1180 from various locations. Sources 1211, 1212 go directly via conduits 1191, 1192 into machine 702 (FIG. 10), preferably to individual process sub-zones of zone 704 which require different conditions. Sources 1181, 1182 are released near machine 702 and go primarily but indirectly into machine 702. Sources 1183, 1184 are released away from machine 702 and go more directly into personnel zone 708. Mixing of source flows 1183, 1184 and 1181, 1182 must, of course, be considered; it is sufficient for our purposes here to disclose that they have different volumetric flow rates and different gas flow conditions as a consequence of interacting with different gas flow or gas conditioning elements downstream of fan 1147, in air and collector drive unit 1140. Further, most of source flows 1181, 1182 return to machine 702 and most of source flows 1183, 1184 are supplied to personnel zone 708. Still further, we consider here that all flows captured by or sourced from modular environmental control apparatus 1100 remain within envelope 1112. This has the important consequence that all heat energy dissipated by materials processing machine 702, modular environmental control apparatus 1100, personnel 700, and various other heat loads within envelope 1112 must be rejected by cooling fluids provided to heat transfer surfaces 718, 722 in unit 1100.

Each of the gas flows 1211, 1212, 1182, 1181, 1183, 1184 captured by environmental control apparatus 1100 can have different volumetric flow rates or different gas conditions. (Note that the flows entering unit 1100 at 1120, or leaving, diffuser 1180, have, for simplicity, the same designations.)

Source flow component 1211 is seen to be subjected to a strong electric field associated with tens of kilovolts impressed on plates 710, as provided by variable power supply 711, thus adding electrical charges. Power supply 711 is controlled by output 511 of microcontroller 1200 seen in FIG. 12 and, for weaving machine 20, as element 200 in FIG. 7A. Flow 1211 is also cleaned by filter element 712.

Source flow 1212 has moisture added by atomizer nozzle 714 which preferably is supplied with "pure" water via pipe 716 according to Neefus et al U.S. Pat. No. 4,753,663. Valve 717, responding to microcontroller 1200 output 517, regulates humidity level in flow 1212.

Heat transfer coils 718 remove heat form flow 1182; said coils preferably have cooled water flowing to them as heat transport fluid but other cooling fluids can be used as are well known in the art. Control valve 719 and output signal 519 regulate temperature in flow 1182. In practice flow 1182 is perhaps 50% of total flow.

Source flow 1181 leaves drive unit 1140 without further conditioning and, like all source flow leaving fan 1147, is a combined mix of capture flows 1183, 1184, 1181, 1182, 1211, 1212 which, as disclosed above, are filtered by elements 110A, 110B (FIG. 3D) but which contains heat and other emissions from process zone(s) 704. Flow component 1181, like all source flows leaving fan 1147, contains its proportional amount of heat energy impart by fan 1147 and waste heat from motor 1146. Most of this flow 1181, like source flow 1182, returns to machine 702 or into collector 1120.

Source flows 1183, 1184 move into personnel zone 708 where desirable conditions are 72° F., 40% RH, respirable dust<500 $\mu g/m^3$ (weaving) neutral ions, cross flows<40

FT/MIN, etc. Such conditions are established by the American Society of Heating, Refrigeration, and Air-Conditioning Engineers, Inc. (ASHRAE), 1791 Tullie Circle NE, ATLANTA, Ga. 30329. To realize these conditions, particularly in the respiratory zone 701 of personnel 700 in personnel zone 708, source flows 1183, 1184 are filtered by element 720 and cooled by element 722. Element 720 is preferably a charcoal filled, paper membrane filter which removes organic gases and fine dust. Element 722 is a cooling coil, like element 718, but the heat rejection fluid is preferably an environmentally safe refrigerant, now well known in the art. Control valve 723 and microcontroller output 523 are noted, as is condensate drain 724.

Figure 12:
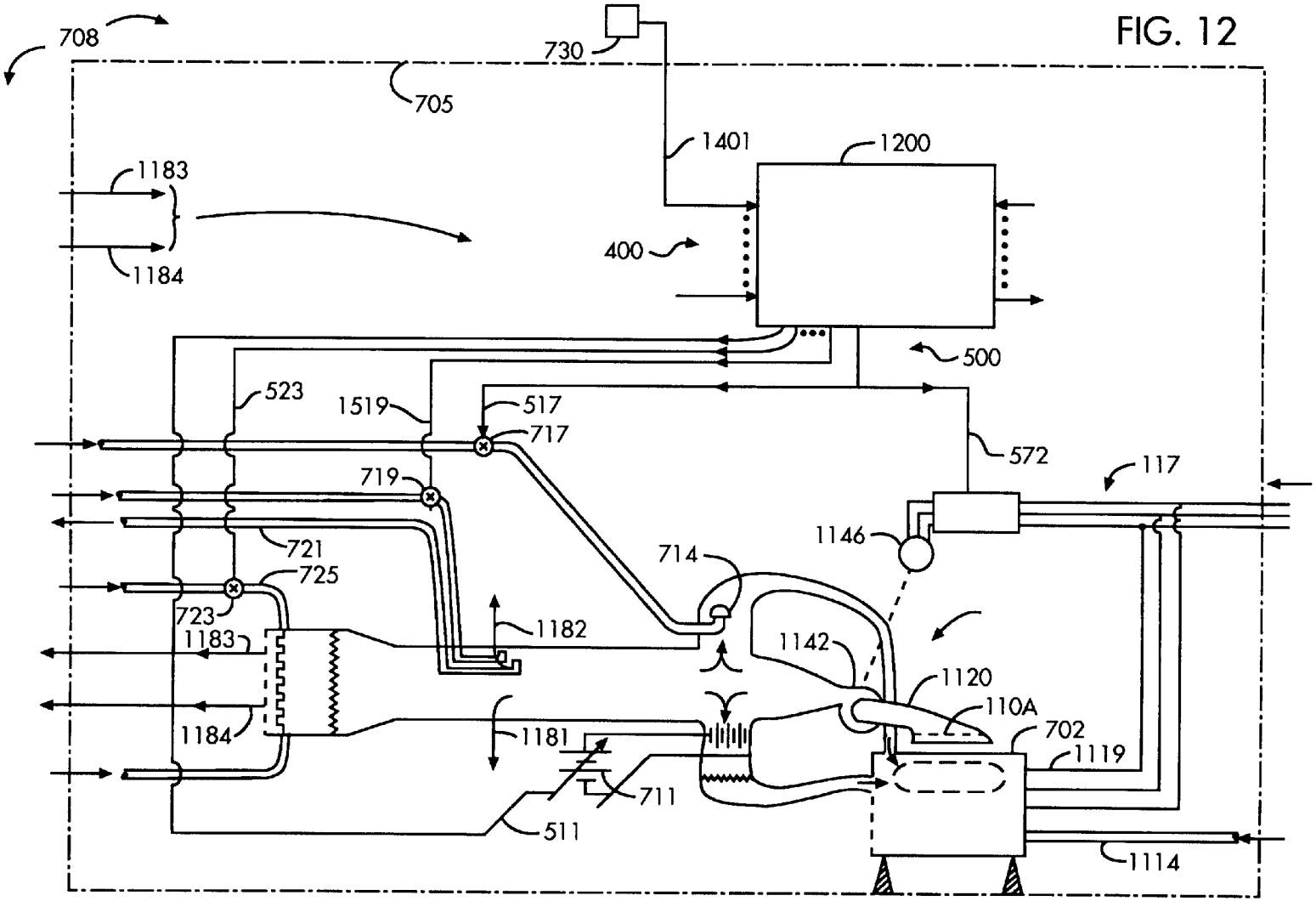

FIG. 12 shows schematically how environmental control apparatus 1100 independently and simultaneously controls environmental conditions in multiple source flows. For simplicity and clarity, we note that only personnel zone 708 temperature is controlled by source flows 1183, 1184. A temperature sensor 730 provides a signal proportional to process zone 708 temperature as input 1401 to microcontroller 1200 which, in turn, provides output 1523 to open refrigeration valve 723, thus controlling or conditioning source air flow components 1181, 1184 into personnel zone 708, i.e., cooling said components.

Measurement and control of any other input 1400 to and output 1500 from microcontroller 1200, corresponding to gas flow conditions in any personnel zone 708 or process zone 704, follows similar, well-known explanation.

FIG. 12 also describes thermodynamic envelope 706 in more detail. Conservation of mass and energy transports across envelope 706 require, to first approximation, that electrical energy into machine 702 and into MECA motor 1146 be offset by heat energy transported out of envelope 706 (and envelope 1112 as well) by cooling water in pipe 721 and refrigerant in pipe 725. That is, for emphasis, modular environmental control unit 1100 is handling the complete gas flow conditioning task.

Detailed engineering thermodynamic analyses along these lines show that modular environmental control equipment can completely eliminate prior art environmental controls (central air conditioning, traveling cleaners) and provide equal or improved personnel and process zone conditions for, typically, one half the electrical power costs of prior art equipment. In some extreme cases, wherein process zone 704 is thermally (and acoustically) insulated, and wherein the process zone(s) 704 can operate at elevated temperatures in the range of 100° to 150° F. (which temperatures are completely incompatible with human comfort or health), ordinary, unrefrigerated cooling tower water can be used in coils 718, thus eliminating refrigeration for this major heat load. In this extreme case, electrical power costs can approach one fourth of prior art equipment of course, refrigerant is still needed in pipe 725 to provide cooling for air flow components 1183, 1184 sourced to personnel zone 708, but humans 700 and support equipment in production zone 1112 represent a minor heat load.

These dramatic savings are but one of the benefits of separating personnel zone 708 and process zone 704.

Various environmental parameters or variables have been discussed in this specification. Table 1 lists, for convenient reference, the primary environmental parameters whose values in personnel zones or process zones are controlled by our invention.

TABLE 1

ENVIRONMENTAL PARAMETERS

Listed below are environmental parameters, whose values in gas flows within personnel zones or processing zones of materials processing machines control the comfort of personnel and the processing performance parameters of said machines, and whose values in said gas flows are controlled by environmental control apparatus according to the instant invention.

| Parameter | Symbol | English Units | Systeme Internationalé Units |
|---|---|---|---|
| Temperature | T | °F. | °C. |
| Humidity, relative | RH | % | % |
| Humidity absolute | H | grains/pound | grams/m$^3$ |
| Dust concentration | C | $\mu$g/m$^3$ | $\mu$g/m$^3$ |
| Composition (Example: Air: 77% $N_2$, 21% $O_2$, 1% Ar, traces) | | | |
| Volumetric flow rate | Q | FT/MIN | m$^3$/MIN |
| Static pressure | P | inches wc | mm wc |
| Free charge concentration | n | FT$^{-3}$ | cm$^{-3}$ |
| Static charge | E | V/M | V/M |
| Radioactive particle concentration | $n_r$ | FT$^{-3}$ | cm$^{-3}$ |
| Velocity | V | FT/MIN | m/SEC |
| Velocity fluctuations | — | various | various |
| Pressure fluctuations | — | various | various |
| Density | ρ | #m/FT$^3$ | Kg/m$^3$ |
| Mass flow rate | M | #m/sec | Kg/sec |
| Enthalpy | h | Btu/#m | KC/Kg |
| Entropy | s | — | — |
| Exchange rate | E | changes/hour | changes/hour |

[1]SI or "customary metric"

E. Optimal Process Control

According to a second major objective, our invention also provides for improved optimal process control for materials processing machines. The first major objective, it can be recalled, is provision of individually controlled or conditioned gas flows to and from process zones and personnel zones associated with said materials processing machines. This second objective is achieved through optimized control of gas flow conditions in process zones and personnel zones. Control is a first and necessary step; optimal control is the real driving force in free market economies, especially as it relates to maximizing gross profit. Our invention enables broader and more effective optimal control of process performance parameters of individual materials processing machines than heretofore possible.

Shofner et al European Patent Application Publication No. 0,604,876 titled "Methods for Optimally Controlling Fiber Processing Machines", which claims priority based on U.S. patent application Ser. No. 999,212, filed Dec. 31, 1992, and Shofner et al U.S. Pat. No. 5,361,450, titled "Direct Control of Fiber Testing or Processing Performance Parameters by Application of Controlled, Conditioned Gas Flows", the entire disclosures of which are hereby incorporated by reference, represent "state of the art" concepts at the time of their U.S. filings.

'876 EPO is directed toward fiber processing, specifically ending with spinning fibers into yarn, and is silent on control of environmental parameters in the machinery process zones. (The preferred embodiment for '876 EPO is open end spinning, FIG. 1 therein.) '876 EPO is totally silent on modular gas flow conditioning means or on conditioning personnel zones.

According to '876 EPO, optimal control of fiber processing machines, which we herein generalize to materials processing machines, is achieved by jointly optimizing machinery characteristics and characteristics of materials fed into the machines, said machinery and material characteristics including cost parameters, not just machine setting or material properties. Our instant invention enables controlling those processing performance parameters which respond, at least in part, to process zone and personnel zone environmental parameters in realizing overall optimal process performance.

Using a textile example, it can be appreciated that adjacent weaving machines of the same model and weaving the same fabric can operate with very different process zone environmental conditions to achieve maximum profit, said process zone conditions being provided by a modular environmental control apparatus for each such machine. Clearly, when adjacent machines are weaving different patterns, different process zone (or even personnel zone) conditions will in general prevail to achieve maximum profit. This flexibility is not possible with prior art central air conditioning or traveling cleaners.

U.S. Pat. No. 5,361,450 is directed toward fiber processing (preferred embodiment carding, FIG. 6 therein) or fiber testing (preferred embodiment, fiber testing instrument, FIG. 1 therein) via control of environmental parameters in the machinery process zones or fiber testing instrument test zones, respectively.

The process zone environmental parameters of U.S. Pat. No. 5,361,450 are controlled by application of conditioned gas flows delivered from improved central air conditioning systems (FIG. 10 of U.S. Pat. No. 5,361,450). Said improvements utilize central air conditioning systems and relate to provision, via fixed distribution ductwork, of variable multiple gas flow conditions to internal process zones of fiber processing machines, like carding, and optimize processing performance parameters thereby. Fixed ductwork is not generally applicable to materials processing machines and is specifically impractical for weaving, for example, where distances closer than about 30 inches are essentially impossible. U.S. Pat. No. 5,361,450 is silent on fabric formation (weaving or knitting), on apparel manufacture ("cut-and-sew") or on generic materials processing. U.S. Pat. No. 5,361,450 is also notably silent on modular process zone and personnel environmental control.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An environmental control apparatus unit comprising:

at least one of a gas flow capture element and a gas flow source element positionable in close proximity to a process zone of a materials processing machine;

an element for directing a conditioned gas flow to a personnel zone; and an element for conditioning a gas flow directed to a machine process zone differently from a gas flow directed to the personnel zone.

2. The environmental control apparatus unit of claim 1, which comprises a blower.

3. An environmental control apparatus unit in accordance with claim 1, wherein said at least one of said gas flow capture element and said gas flow source element is positionable in close proximity to a process zone of a textile processing machine.

4. An environmental control apparatus unit in accordance with claim 1, wherein said at least one of said gas flow capture element and said gas flow source element is positionable in close proximity to a process zone of a textile fiber processing machine.

5. An environmental control apparatus unit in accordance with claim 1, wherein said at least one of said gas flow capture element and said gas flow source element is positionable in close proximity to a process zone of a textile yarn processing machine.

6. An environmental control apparatus unit in accordance with claim 1, wherein said at least one of said gas flow capture element and said gas flow source element is positionable in close proximity to a process zone of a fabric processing machine.

* * * * *